US009875618B2

(12) United States Patent
SeLegue et al.

(10) Patent No.: US 9,875,618 B2
(45) Date of Patent: Jan. 23, 2018

(54) GAMING SYSTEM AND METHOD EMPLOYING MULTI-DIRECTIONAL INTERACTION BETWEEN MULTIPLE CONCURRENTLY PLAYED GAMES

(71) Applicant: IGT, Las Vegas, NV (US)

(72) Inventors: Dylan B. SeLegue, Reno, NV (US); Ross D. Wenker, Sparks, NV (US)

(73) Assignee: IGT, Las Vegas, NV (US)

( * ) Notice: Subject to any disclaimer, the term of this patent is extended or adjusted under 35 U.S.C. 154(b) by 256 days.

(21) Appl. No.: 14/790,642

(22) Filed: Jul. 2, 2015

(65) Prior Publication Data

US 2016/0027251 A1 Jan. 28, 2016

Related U.S. Application Data

(60) Provisional application No. 62/028,625, filed on Jul. 24, 2014.

(51) Int. Cl.
*A63F 9/00* (2006.01)
*G07F 17/32* (2006.01)

(52) U.S. Cl.
CPC ..... *G07F 17/3267* (2013.01)

(58) Field of Classification Search
None
See application file for complete search history.

(56) References Cited

U.S. PATENT DOCUMENTS 4,335,809 A 6/1982 Wain
4,448,419 A 5/1984 Telnaes
4,467,424 A 8/1984 Hedges et al.
4,527,798 A 7/1985 Siekierski et al.
4,572,509 A 2/1986 Sitrick
4,582,324 A 4/1986 Koza et al.
4,621,814 A 11/1986 Stepan et al.
4,624,459 A 11/1986 Kaufman
4,652,998 A 3/1987 Koza et al.
4,669,730 A 6/1987 Small
4,679,143 A 7/1987 Hagiwara
4,695,053 A 9/1987 Vazquez, Jr. et al.
4,732,386 A 3/1988 Rayfiel
(Continued)

FOREIGN PATENT DOCUMENTS

AU 738686 3/1999
AU 200157669 7/2001
(Continued)

OTHER PUBLICATIONS

Slot Accounting System, published by IGT printed prior to Sep. 28, 2011.

(Continued)

*Primary Examiner* — Seng H Lim
(74) *Attorney, Agent, or Firm* — Neal, Gerber & Eisenberg LLP

(57) ABSTRACT

A gaming system which includes a plurality of overlapping game plays each configured to activate zero, one or more features. Following any activation of one or more features of at least one of the overlapping game plays, the gaming system causes such activated features to also be activated in one or more of the other overlapping game plays independent of which specific game play such features were activated initially for.

21 Claims, 13 Drawing Sheets

(56) References Cited

U.S. PATENT DOCUMENTS 4,738,451 A 4/1988 Logg
4,743,002 A 5/1988 Menzel
4,756,531 A 7/1988 DiRe
4,775,155 A 10/1988 Lees
4,805,907 A 2/1989 Hagiwara
4,838,552 A 6/1989 Hagiwara
4,842,278 A 6/1989 Markowicz
4,856,787 A 8/1989 Itkis
4,858,930 A 8/1989 Sato
4,861,041 A 8/1989 Jones et al.
4,866,515 A 9/1989 Tagawa et al.
4,871,171 A 10/1989 Rivero
4,874,164 A 10/1989 Miner et al.
4,874,173 A 10/1989 Kishishita
4,922,522 A 5/1990 Scanlon
4,924,378 A 5/1990 Hershey et al.
4,926,327 A 5/1990 Sidley
4,964,638 A 10/1990 Ishida
4,991,848 A 2/1991 Greenwood et al.
5,019,973 A 5/1991 Wilcox et al.
5,042,810 A 8/1991 Williams
5,083,271 A 1/1992 Thacher et al.
5,116,055 A 5/1992 Tracy
5,138,712 A 8/1992 Corbin
5,142,622 A 8/1992 Owens
5,152,529 A 10/1992 Okada
5,159,549 A 10/1992 Hallman, Jr. et al.
5,178,390 A 1/1993 Okada
5,178,395 A 1/1993 Lovell
5,179,517 A 1/1993 Sarbin et al.
5,209,476 A 5/1993 Eiba
5,242,163 A 9/1993 Fulton
5,248,142 A 9/1993 Breeding
5,249,800 A 10/1993 Hilgendorf et al.
5,259,613 A 11/1993 Marnell, II
5,269,687 A 12/1993 Mott et al.
5,275,400 A 1/1994 Weingardt et al.
5,276,312 A 1/1994 McCarthy
5,277,424 A 1/1994 Wilms
5,280,909 A 1/1994 Tracy
5,288,081 A 2/1994 Breeding
5,288,978 A 2/1994 Iijima
5,297,252 A 3/1994 Becker
5,305,195 A 4/1994 Murphy
5,324,035 A 6/1994 Morris et al.
5,342,047 A 8/1994 Heidel et al.
5,344,144 A 9/1994 Canon
5,349,642 A 9/1994 Kingdon
5,356,140 A 10/1994 Dabrowski et al.
5,370,399 A 12/1994 Liverance
5,371,345 A 12/1994 LeStrange et al.
5,375,206 A 12/1994 Hunter et al.
5,377,973 A 1/1995 Jones et al.
5,377,993 A 1/1995 Josephs
5,390,934 A 2/1995 Grassa
5,393,057 A 2/1995 Marnell, II
5,393,061 A 2/1995 Manship et al.
5,393,067 A 2/1995 Paulsen et al.
5,395,111 A 3/1995 Inoue
5,395,242 A 3/1995 Slye et al.
5,397,128 A 3/1995 Hesse et al.
5,397,133 A 3/1995 Penzias
5,404,567 A 4/1995 DePietro et al.
5,407,200 A 4/1995 Zalabah
5,408,600 A 4/1995 Garfinkel et al.
5,411,258 A 5/1995 Wilson et al.
5,411,271 A 5/1995 Mirando
5,415,416 A 5/1995 Scagnelli et al.
5,429,361 A 7/1995 Raven et al.
5,430,791 A 7/1995 Feit et al.
5,438,508 A 8/1995 Wyman
5,449,173 A 9/1995 Thomas et al.
5,450,938 A 9/1995 Rademacher
5,465,082 A 11/1995 Weingardt
5,470,079 A 11/1995 LeStrange et al.
5,471,577 A 11/1995 Lightbody et al.
5,472,194 A 12/1995 Breeding et al.
5,489,103 A 2/1996 Okamoto
5,498,003 A 3/1996 Gechter
5,499,340 A 3/1996 Barritz
5,501,455 A 3/1996 Hirata et al.
5,507,491 A 4/1996 Gatto et al.
5,511,781 A 4/1996 Wood et al.
5,530,232 A 6/1996 Taylor
5,531,448 A 7/1996 Moody
5,536,016 A 7/1996 Thompson
5,544,892 A 8/1996 Breeding
5,559,313 A 9/1996 Claus et al.
5,560,603 A 10/1996 Seelig et al.
5,564,700 A 10/1996 Celona
5,566,337 A 10/1996 Szymanski et al.
5,569,084 A 10/1996 Nicastro et al.
5,570,885 A 11/1996 Ornstein
5,578,808 A 11/1996 Taylor
5,580,309 A 12/1996 Piechowiak et al.
5,584,764 A 12/1996 Inoue
5,586,257 A 12/1996 Perlman
5,586,937 A 12/1996 Menashe
5,588,650 A 12/1996 Eman et al.
5,593,349 A 1/1997 Miguel et al.
5,609,337 A 3/1997 Clapper, Jr.
5,609,524 A 3/1997 Inoue
5,611,730 A 3/1997 Weiss
5,617,331 A 4/1997 Wakai et al.
5,626,341 A 5/1997 Jones et al.
5,630,753 A 5/1997 Fuchs
5,630,757 A 5/1997 Gagin et al.
5,632,485 A 5/1997 Woodland et al.
5,639,088 A 6/1997 Schneider et al.
5,639,089 A 6/1997 Matsumoto et al.
5,640,192 A 6/1997 Garfinkle
5,643,086 A 7/1997 Alcorn et al.
5,645,486 A 7/1997 Nagao et al.
5,647,798 A 7/1997 Falciglia
5,649,118 A 7/1997 Carlisle et al.
5,655,603 A 8/1997 Schulte et al.
5,655,961 A 8/1997 Acres et al.
5,664,998 A 9/1997 Seelig et al.
5,671,412 A 9/1997 Christiano
5,673,917 A 10/1997 Vancura
5,674,128 A 10/1997 Holch et al.
5,697,843 A 12/1997 Manship et al.
5,702,304 A 12/1997 Acres et al.
5,704,835 A 1/1998 Dietz, II
5,707,286 A 1/1998 Carlson
5,708,709 A 1/1998 Rose
5,717,604 A 2/1998 Wiggins
5,720,662 A 2/1998 Holmes, Jr. et al.
5,722,891 A 3/1998 Inoue
5,730,654 A 3/1998 Brown
5,732,950 A 3/1998 Moody
5,741,183 A 4/1998 Acres et al.
5,743,523 A 4/1998 Kelly et al.
5,745,879 A 4/1998 Wyman
5,752,882 A 5/1998 Acres et al.
5,755,619 A 5/1998 Matsumoto et al.
5,755,621 A 5/1998 Marks et al.
5,758,069 A 5/1998 Olsen
5,759,102 A 6/1998 Pease et al.
5,759,103 A 6/1998 Freels et al.
5,761,647 A 6/1998 Boushy
5,761,649 A 6/1998 Hill
5,762,552 A 6/1998 Vuong et al.
5,766,076 A 6/1998 Pease et al.
5,768,382 A 6/1998 Schneier et al.
5,769,716 A 6/1998 Saffari et al.
5,770,533 A 6/1998 Franchi
5,772,509 A 6/1998 Weiss
5,775,692 A 7/1998 Watts et al.
5,779,544 A 7/1998 Seelig et al.
5,779,545 A 7/1998 Berg et al.
5,779,549 A 7/1998 Walker et al.
5,788,573 A 8/1998 Baerlocher et al.
5,788,574 A 8/1998 Ornstein et al.

(56) References Cited

U.S. PATENT DOCUMENTS 5,790,818 A 8/1998 Martin
5,791,992 A 8/1998 Crump et al.
5,800,268 A 9/1998 Molnick
5,806,855 A 9/1998 Cherry
5,816,915 A 10/1998 Kadlik
5,816,918 A 10/1998 Kelly et al.
5,820,459 A 10/1998 Acres et al.
5,820,460 A 10/1998 Fulton
5,823,873 A 10/1998 Moody
5,823,874 A 10/1998 Adams
5,823,879 A 10/1998 Goldberg et al.
5,828,840 A 10/1998 Cowan et al.
5,829,749 A 11/1998 Hobert et al.
5,830,069 A 11/1998 Soltesz et al.
5,833,536 A 11/1998 Davids et al.
5,833,537 A 11/1998 Barrie
5,833,540 A 11/1998 Miodunski et al.
5,836,817 A 11/1998 Acres et al.
5,839,730 A 11/1998 Pike
5,845,283 A 12/1998 Williams et al.
5,848,932 A 12/1998 Adams
5,851,011 A 12/1998 Loff
5,851,148 A 12/1998 Brune et al.
5,851,149 A 12/1998 Xidos et al.
5,855,515 A 1/1999 Pease et al.
5,871,398 A 2/1999 Schneier et al.
5,873,781 A 2/1999 Keane
5,876,284 A 3/1999 Acres et al.
5,882,261 A 3/1999 Adams
5,885,158 A 3/1999 Torango et al.
5,890,962 A 4/1999 Takemoto
5,903,732 A 5/1999 Reed et al.
5,905,248 A 5/1999 Russell et al.
5,911,418 A 6/1999 Adams
5,913,164 A 6/1999 Pawa et al.
5,917,725 A 6/1999 Thacher et al.
5,918,039 A 6/1999 Buswell et al.
5,919,088 A 7/1999 Weiss
5,923,379 A 7/1999 Patterson
5,925,127 A 7/1999 Ahmad
5,927,714 A 7/1999 Kaplan
5,935,002 A 8/1999 Falciglia
5,941,773 A 8/1999 Harlick
5,947,820 A 9/1999 Morro et al.
5,947,822 A 9/1999 Weiss
5,951,397 A 9/1999 Dickinson
5,951,611 A 9/1999 La Pierre
5,957,775 A 9/1999 Cherry
5,967,896 A 10/1999 Jorasch et al.
5,971,271 A 10/1999 Wynn et al.
5,971,849 A 10/1999 Falciglia
5,974,409 A 10/1999 Sanu et al.
5,980,093 A 11/1999 Jones et al.
5,980,384 A 11/1999 Barrie
5,983,190 A 11/1999 Trower, II et al.
5,984,779 A 11/1999 Bridgeman et al.
5,984,782 A 11/1999 Inoue
5,991,760 A 11/1999 Gauvin et al.
5,991,790 A 11/1999 Shah et al.
5,995,146 A 11/1999 Rasmussen
5,996,068 A 11/1999 Dwyer, III et al.
5,997,401 A 12/1999 Crawford
5,999,808 A 12/1999 LaDue
6,001,016 A 12/1999 Walker et al.
6,003,013 A 12/1999 Boushy et al.
6,003,066 A 12/1999 Ryan et al.
6,003,094 A 12/1999 Dean
6,003,123 A 12/1999 Carter et al.
6,004,207 A 12/1999 Wilson, Jr. et al.
6,004,208 A 12/1999 Takemoto et al.
6,006,252 A 12/1999 Wolfe
6,011,850 A 1/2000 Bertrand et al.
6,012,982 A 1/2000 Piechowiak et al.
6,012,983 A 1/2000 Walker et al.
6,012,984 A 1/2000 Roseman
6,015,346 A 1/2000 Bennett
6,019,369 A 2/2000 Nakagawa et al.
6,019,374 A 2/2000 Breeding
6,024,640 A 2/2000 Walker et al.
6,024,642 A 2/2000 Stupak
6,026,433 A 2/2000 D'Arlach et al.
6,033,307 A 3/2000 Vancura
6,039,648 A 3/2000 Guinn et al.
6,056,641 A 5/2000 Webb
6,059,289 A 5/2000 Vancura
6,059,658 A 5/2000 Mangano et al.
6,062,980 A 5/2000 Luciano
6,068,552 A 5/2000 Walker et al.
6,068,982 A 5/2000 Rolfe et al.
6,071,190 A 6/2000 Weiss et al.
6,077,162 A 6/2000 Weiss
6,079,711 A 6/2000 Wei et al.
6,080,062 A 6/2000 Olson
6,085,247 A 7/2000 Parsons, Jr. et al.
6,089,975 A 7/2000 Dunn
6,089,976 A 7/2000 Schneider et al.
6,089,978 A 7/2000 Adams
6,089,980 A 7/2000 Gauselmann
6,089,981 A 7/2000 Brenner et al.
6,089,982 A 7/2000 Holch et al.
6,093,102 A 7/2000 Bennett
6,099,408 A 8/2000 Schneier et al.
6,102,798 A 8/2000 Bennett
6,104,815 A 8/2000 Alcorn et al.
6,106,396 A 8/2000 Alcorn et al.
6,108,420 A 8/2000 Larose et al.
6,110,041 A 8/2000 Walker et al.
6,110,043 A 8/2000 Olsen
6,113,098 A 9/2000 Adams
6,113,102 A 9/2000 Marks et al.
6,113,495 A 9/2000 Walker et al.
6,117,011 A 9/2000 Lvov
6,117,013 A 9/2000 Eiba
6,120,031 A 9/2000 Adams
6,120,377 A 9/2000 McGinnis, Sr. et al.
6,120,378 A 9/2000 Moody et al.
6,126,542 A 10/2000 Fier
6,126,544 A 10/2000 Kojima
6,135,884 A 10/2000 Hedrick et al.
6,135,887 A 10/2000 Pease et al.
6,141,737 A 10/2000 Krantz et al.
6,142,872 A 11/2000 Walker et al.
6,142,873 A 11/2000 Weiss et al.
6,146,273 A 11/2000 Olsen
6,149,522 A 11/2000 Alcorn et al.
6,151,707 A 11/2000 Hecksel et al.
6,159,095 A 12/2000 Frohm et al.
6,159,097 A 12/2000 Gura
6,159,098 A 12/2000 Slomiany et al.
6,162,121 A 12/2000 Morro et al.
6,162,122 A 12/2000 Acres et al.
6,168,520 B1 1/2001 Baerlocher et al.
6,173,955 B1 1/2001 Perrie et al.
6,174,235 B1 1/2001 Walker et al.
6,179,711 B1 1/2001 Yoseloff
6,183,362 B1 2/2001 Boushy
6,183,366 B1 2/2001 Goldberg et al.
6,186,894 B1 2/2001 Mayeroff
6,190,254 B1 2/2001 Bennett
6,190,255 B1 2/2001 Thomas et al.
6,196,920 B1 3/2001 Spaur et al.
6,203,427 B1 3/2001 Walker et al.
6,203,428 B1 3/2001 Giobbi et al.
6,203,429 B1 3/2001 Demar et al.
6,203,430 B1 3/2001 Walker et al.
6,204,560 B1 3/2001 Daetwyler et al.
6,206,782 B1 3/2001 Walker et al.
6,210,274 B1 4/2001 Carlson
6,210,277 B1 4/2001 Stefan
6,210,279 B1 4/2001 Dickinson
6,219,836 B1 4/2001 Wells et al.
6,224,482 B1 5/2001 Bennett
6,224,483 B1 5/2001 Mayeroff
6,224,486 B1 5/2001 Walker et al.

(56) References Cited

U.S. PATENT DOCUMENTS 6,227,969 B1 5/2001 Yoseloff
6,227,971 B1 5/2001 Weiss
6,227,972 B1 5/2001 Walker et al.
6,231,442 B1 5/2001 Mayeroff
6,234,896 B1 5/2001 Walker et al.
6,234,897 B1 5/2001 Frohm et al.
6,234,900 B1 5/2001 Cumbers
6,237,916 B1 5/2001 Webb
6,241,608 B1 6/2001 Torango
6,251,014 B1 6/2001 Stockdale et al.
6,254,481 B1 7/2001 Jaffe
6,254,483 B1 7/2001 Acres
6,257,981 B1 7/2001 Acres et al.
6,261,177 B1 7/2001 Bennett
6,264,557 B1 7/2001 Schneier et al.
6,264,561 B1 7/2001 Saffari et al.
6,270,411 B1 8/2001 Gura et al.
6,270,412 B1 8/2001 Crawford et al.
6,272,223 B1 8/2001 Carlson
6,273,821 B1 8/2001 Moriguchi
6,283,855 B1 9/2001 Bingham
6,286,003 B1 9/2001 Muta
6,287,200 B1 9/2001 Sharma
6,287,202 B1 9/2001 Pascal et al.
6,290,600 B1 9/2001 Glasson
6,293,866 B1 9/2001 Walker et al.
6,302,790 B1 10/2001 Brossard
6,304,905 B1 10/2001 Clark
6,308,271 B2 10/2001 Tanaka
6,309,300 B1 10/2001 Glavich
6,312,332 B1 11/2001 Walker et al.
6,312,333 B1 11/2001 Acres
6,312,334 B1 11/2001 Yoseloff
6,315,660 B1 11/2001 DeMar et al.
6,315,664 B1 11/2001 Baerlocher et al.
6,315,666 B1 11/2001 Mastera et al.
6,319,122 B1 11/2001 Packes, Jr. et al.
6,319,125 B1 11/2001 Acres
6,322,445 B1 11/2001 Miller
6,328,649 B1 12/2001 Randall et al.
6,334,104 B1 12/2001 Hirai
6,334,814 B1 1/2002 Adams
6,336,857 B1 1/2002 McBride
6,338,678 B1 1/2002 Seelig et al.
6,343,988 B1 2/2002 Walker et al.
6,345,386 B1 2/2002 Delo et al.
6,346,048 B1 2/2002 Ogawa et al.
6,347,795 B1 2/2002 DeLeljer
6,347,996 B1 2/2002 Gilmore et al.
6,353,928 B1 3/2002 Altberg et al.
6,354,941 B2 3/2002 Miller et al.
6,354,946 B1 3/2002 Finn
6,358,144 B1 3/2002 Kadlic et al.
6,358,146 B1 3/2002 Adams
6,358,150 B1 3/2002 Mir et al.
6,361,437 B1 3/2002 Walker et al.
6,361,441 B1 3/2002 Walker et al.
6,364,314 B1 4/2002 Canterbury
6,364,766 B1 4/2002 Anderson et al.
6,368,216 B1 4/2002 Hedrick et al.
6,373,500 B1 4/2002 Daniels
6,375,187 B1 4/2002 Baerlocher
6,375,567 B1 4/2002 Acres
6,379,246 B1 4/2002 Dabrowski
6,379,248 B1 4/2002 Jorasch et al.
6,383,074 B1 5/2002 Boggs
6,389,538 B1 5/2002 Gruse et al.
6,389,589 B1 5/2002 Mishra et al.
6,394,902 B1 5/2002 Glavich et al.
6,394,907 B1 5/2002 Rowe
6,397,381 B1 5/2002 Delo et al.
6,398,218 B1 6/2002 Vancura
6,398,644 B1 6/2002 Perrie et al.
6,398,645 B1 6/2002 Yoseloff
6,398,664 B1 6/2002 Choi
6,402,614 B1 6/2002 Schneier et al.
6,402,618 B1 6/2002 Reed et al.
6,406,369 B1 6/2002 Baerlocher et al.
6,406,371 B1 6/2002 Baba et al.
6,409,602 B1 6/2002 Wiltshire et al.
6,413,160 B1 7/2002 Vancura
6,413,162 B1 7/2002 Baerlocher et al.
6,418,554 B1 7/2002 Delo et al.
6,419,579 B1 7/2002 Bennett
6,425,823 B1 7/2002 Byrne
6,425,828 B2 7/2002 Walker et al.
6,427,227 B1 7/2002 Chamberlain
6,428,412 B1 8/2002 Anderson et al.
6,428,413 B1 8/2002 Carlson
6,431,983 B2 8/2002 Acres
6,434,398 B1 8/2002 Inselberg
6,439,995 B1 8/2002 Hughs-Baird et al.
6,439,996 B2 8/2002 LeMay et al.
6,442,529 B1 8/2002 Krishan et al.
6,443,837 B1 9/2002 Jaffe et al.
6,443,839 B2 9/2002 Stockdale et al.
6,443,841 B1 9/2002 Rossides
6,450,887 B1 9/2002 Mir et al.
6,454,650 B1 9/2002 Aronin
6,454,651 B1 9/2002 Yoseloft
6,457,175 B1 9/2002 Lerche
RE37,885 E 10/2002 Acres et al.
6,461,241 B1 10/2002 Webb et al.
6,482,089 B2 11/2002 Demar et al.
6,488,580 B1 12/2002 Robb
6,488,585 B1 12/2002 Wells et al.
6,491,584 B2 12/2002 Graham et al.
6,494,454 B2 12/2002 Adams
6,503,146 B2 1/2003 Walker et al.
6,503,147 B1 1/2003 Baerlocher et al.
6,506,117 B2 1/2003 DeMar et al.
6,508,707 B2 1/2003 DeMar et al.
6,508,709 B1 1/2003 Karmarkar
6,508,710 B1 1/2003 Paravia et al.
6,511,068 B1 1/2003 Sklansky et al.
6,514,144 B2 2/2003 Riendeau et al.
6,517,073 B1 2/2003 Vancura
6,517,433 B2 2/2003 Loose et al.
6,520,856 B1 2/2003 Walker et al.
6,523,166 B1 2/2003 Mishra et al.
6,523,829 B1 2/2003 Walker et al.
6,527,638 B1 3/2003 Walker et al.
6,532,543 B1 3/2003 Smith et al.
6,533,664 B1 3/2003 Crumby
6,549,912 B1 4/2003 Chen
6,554,709 B1 4/2003 Brenner et al.
6,554,710 B1 4/2003 Olson
6,560,639 B1 5/2003 Dan et al.
6,561,904 B2 5/2003 Locke et al.
6,565,434 B1 5/2003 Acres
6,575,832 B1 6/2003 Manfredi et al.
6,578,199 B1 6/2003 Tsou et al.
6,579,179 B2 6/2003 Poole et al.
6,592,457 B1 7/2003 Frohm et al.
6,592,460 B2 7/2003 Torango
6,595,855 B2 7/2003 Sako
6,595,856 B1 7/2003 Ginsburg et al.
6,607,195 B2 8/2003 Vancura
6,607,439 B2 8/2003 Schneier et al.
6,607,441 B1 8/2003 Acres
6,609,978 B1 8/2003 Paulsen
6,620,047 B1 9/2003 Alcorn et al.
6,628,939 B2 9/2003 Paulsen
6,638,170 B1 10/2003 Crumby
6,644,664 B2 11/2003 Muir et al.
6,645,077 B2 11/2003 Rowe
6,648,758 B2 11/2003 Bennett et al.
6,652,378 B2 11/2003 Cannon et al.
6,656,040 B1 12/2003 Brosnan et al.
6,656,044 B1 12/2003 Lewis
6,663,488 B1 12/2003 Adams
6,679,497 B2 1/2004 Walker et al.
6,682,423 B2 1/2004 Brosnan et al.
6,685,567 B2 2/2004 Cockerille et al.

(56) References Cited

U.S. PATENT DOCUMENTS 6,692,003 B2 2/2004 Potter et al.
6,695,696 B1 2/2004 Kaminkow
6,702,289 B1 3/2004 Feola
6,712,699 B2 3/2004 Walker et al.
6,712,702 B2 3/2004 Goldberg et al.
6,722,985 B2 4/2004 Criss-Puszkiewicz et al.
6,722,986 B1 4/2004 Lyons et al.
6,726,565 B2 4/2004 Hughs-Baird
6,733,390 B2 5/2004 Walker et al.
6,746,327 B2 6/2004 Frohm et al.
6,746,328 B2 6/2004 Cannon et al.
6,749,510 B2 6/2004 Giobbi
6,755,738 B2 6/2004 Glasson et al.
6,769,982 B1 8/2004 Brosnan
6,780,111 B2 8/2004 Cannon et al.
6,782,477 B2 8/2004 McCarroll
6,786,819 B2 9/2004 Baerlocher et al.
6,789,801 B2 9/2004 Snow
6,790,142 B2 9/2004 Okada et al.
6,790,143 B2 9/2004 Crumby
6,793,578 B2 9/2004 Luccesi et al.
6,802,778 B1 10/2004 LeMay et al.
6,804,763 B1 10/2004 Stockdale et al.
6,805,629 B1 10/2004 Weiss
6,805,634 B1 10/2004 Wells et al.
6,811,488 B2 11/2004 Paravia et al.
6,813,765 B1 11/2004 Flores
6,816,882 B1 11/2004 Conner et al.
6,819,345 B1 11/2004 Jones et al.
6,823,456 B1 11/2004 Dan et al.
6,827,646 B2 12/2004 Adams
6,830,515 B2 12/2004 Rowe
6,832,957 B2 12/2004 Falconer
6,832,958 B2 12/2004 Acres et al.
6,834,245 B2 12/2004 Ota et al.
6,835,134 B2 12/2004 Poole et al.
6,836,794 B1 12/2004 Lucovsky et al.
6,837,788 B2 1/2005 Cannon
6,837,793 B2 1/2005 McClintic
6,843,723 B2 1/2005 Joshi
6,843,725 B2 1/2005 Nelson
6,846,238 B2 1/2005 Wells
6,852,028 B2 2/2005 Vancura
6,852,031 B1 2/2005 Rowe
6,855,054 B2 2/2005 White et al.
6,855,057 B2 2/2005 Namba et al.
6,857,959 B1 2/2005 Nguyen
6,860,810 B2 3/2005 Cannon et al.
6,863,608 B1 3/2005 LeMay et al.
6,866,581 B2 3/2005 Martinek et al.
6,866,584 B2 3/2005 Michaelson
6,866,586 B2 3/2005 Oberberger et al.
6,875,109 B2 4/2005 Stockdale
6,875,110 B1 4/2005 Crumby
6,878,063 B2 4/2005 Manfredi et al.
6,884,162 B2 4/2005 Raverdy et al.
6,884,166 B2 4/2005 Leen et al.
6,884,170 B2 4/2005 Rowe
6,884,171 B2 4/2005 Eck et al.
6,884,173 B2 4/2005 Gauselmann
6,884,174 B2 4/2005 Lundy et al.
6,887,151 B2 5/2005 Leen et al.
6,887,156 B2 5/2005 DeWeese et al.
6,889,159 B2 5/2005 Klotz et al.
6,890,256 B2 5/2005 Walker et al.
6,896,615 B2 5/2005 Berman
6,896,616 B2 5/2005 Weiss
6,896,617 B2 5/2005 Daly
6,896,618 B2 5/2005 Benoy et al.
6,899,627 B2 5/2005 Lam et al.
6,899,628 B2 5/2005 Leen et al.
6,901,375 B2 5/2005 Fernandez
6,902,478 B2 6/2005 McClintic
6,902,481 B2 6/2005 Breckner et al.
6,908,390 B2 6/2005 Nguyen et al.
6,908,391 B2 6/2005 Gatto et al.
6,910,965 B2 6/2005 Downes
6,921,334 B1 7/2005 Bennett
6,928,413 B1 8/2005 Pulitzer
6,932,700 B2 8/2005 Bennett et al.
6,939,226 B1 9/2005 Joshi
6,939,234 B2 9/2005 Beatty
6,942,571 B1 9/2005 McAllister et al.
6,942,574 B1 9/2005 LeMay et al.
6,945,870 B2 9/2005 Gatto et al.
RE38,812 E 10/2005 Acres et al.
6,955,604 B1 10/2005 Graves et al.
6,960,136 B2 11/2005 Joshi et al.
6,986,055 B2 1/2006 Carlson
6,991,538 B2 1/2006 Cannon
6,991,544 B2 1/2006 Soltys et al.
7,029,395 B1 4/2006 Baerlocher
7,051,004 B2 5/2006 Nuttal et al.
7,056,215 B1 6/2006 Olive
7,066,815 B2 6/2006 Walker et al.
7,083,520 B2 8/2006 Rowe
7,108,602 B2 9/2006 Daly
7,108,603 B2 9/2006 Olive
7,111,845 B2 9/2006 Walker et al.
7,125,333 B2 10/2006 Brosnan
7,144,321 B2 12/2006 Mayeroff
7,156,735 B2 1/2007 Brosnan et al.
7,156,741 B2 1/2007 Hornik et al.
7,201,654 B1 4/2007 Jarvis et al.
7,226,358 B2 6/2007 Miller et al.
7,260,834 B1 8/2007 Carlson
7,285,049 B1 10/2007 Luciano, Jr. et al.
7,297,059 B2 11/2007 Vancura et al.
7,311,601 B2 12/2007 Anderson et al.
7,311,605 B2 12/2007 Moser
7,316,619 B2 1/2008 Nelson
7,329,179 B2 2/2008 Baerlocher
7,331,858 B2 2/2008 McComb et al.
7,341,518 B2 3/2008 Muskin
7,351,144 B2 4/2008 Daly
7,351,146 B2 4/2008 Kaminkow
7,361,089 B2 4/2008 Daly et al.
7,425,177 B2 9/2008 Rodgers et al.
7,427,236 B2 9/2008 Kaminkow et al.
7,429,215 B2 9/2008 Rozkin et al.
7,455,591 B2 11/2008 Nguyen
7,470,196 B1 12/2008 Joshi
7,476,153 B2 1/2009 Walker et al.
7,503,849 B2 3/2009 Hornik et al.
7,513,828 B2 4/2009 Nguyen et al.
7,594,851 B2 9/2009 Falconer
7,601,061 B2 10/2009 Jackson
7,601,062 B2 10/2009 Cole et al.
7,611,406 B2 11/2009 Fuller
7,611,411 B2 11/2009 Griswold et al.
7,617,151 B2 11/2009 Rowe
7,625,280 B2 12/2009 Singer et al.
7,641,555 B2 1/2010 McKinley et al.
7,654,895 B2 2/2010 Pacey
7,722,466 B2 5/2010 Rothschild
7,727,069 B1 6/2010 Nelson
7,758,417 B2 7/2010 Jorasch et al.
7,780,517 B2 8/2010 Saffari et al.
7,805,680 B2 9/2010 Meyers et al.
7,806,764 B2 10/2010 Brosnan et al.
7,837,554 B2 11/2010 Kaminkow et al.
7,841,939 B2 11/2010 Baerlocher et al.
7,862,427 B2 1/2011 Nguyen et al.
7,896,741 B2 3/2011 Kuehling et al.
7,901,294 B2 3/2011 Walker et al.
7,918,738 B2 4/2011 Paulsen
7,927,212 B2 4/2011 Hedrick et al.
7,931,532 B2 4/2011 Johnson
7,934,993 B2 5/2011 Kuehling et al.
7,950,994 B2 5/2011 Berman et al.
7,980,948 B2 7/2011 Rowe et al.
7,988,549 B2 8/2011 Little
7,988,551 B2 8/2011 Walker et al.
8,016,679 B2 9/2011 Steil et al.

(56) References Cited

U.S. PATENT DOCUMENTS

| | | | |
|---|---|---|---|
| 8,029,360 | B2 | 10/2011 | Lind et al. |
| 8,029,365 | B2 | 10/2011 | Burke et al. |
| 8,083,585 | B2 | 12/2011 | Brosnan |
| 8,100,755 | B2 | 1/2012 | Enzminger |
| 8,142,291 | B2 | 3/2012 | Ryan |
| 8,157,633 | B2 | 4/2012 | Kaminkow |
| 8,171,158 | B1 | 5/2012 | Grignetti |
| 8,241,124 | B2 | 8/2012 | Kelly et al. |
| 8,323,101 | B2 | 12/2012 | Anderson et al. |
| 2001/0004609 | A1 | 6/2001 | Walker et al. |
| 2001/0034268 | A1 | 10/2001 | Thomas et al. |
| 2001/0036857 | A1 | 11/2001 | Mothwurf et al. |
| 2001/0044337 | A1 | 11/2001 | Rowe et al. |
| 2001/0044339 | A1 | 11/2001 | Cordero et al. |
| 2001/0046893 | A1 | 11/2001 | Giobbi et al. |
| 2001/0049305 | A1 | 12/2001 | Riendeau et al. |
| 2001/0055990 | A1 | 12/2001 | Acres |
| 2002/0025850 | A1 | 2/2002 | Hafezi |
| 2002/0032049 | A1 | 3/2002 | Walker et al. |
| 2002/0037767 | A1 | 3/2002 | Ebin |
| 2002/0045472 | A1 | 4/2002 | Adams |
| 2002/0045474 | A1 | 4/2002 | Singer et al. |
| 2002/0045484 | A1 | 4/2002 | Eck et al. |
| 2002/0057800 | A1 | 5/2002 | Gordon et al. |
| 2002/0058546 | A2 | 5/2002 | Acres |
| 2002/0068629 | A1 | 6/2002 | Allen et al. |
| 2002/0068631 | A1 | 6/2002 | Raverdy et al. |
| 2002/0071557 | A1 | 6/2002 | Nguyen |
| 2002/0071560 | A1 | 6/2002 | Kurn et al. |
| 2002/0073043 | A1 | 6/2002 | Herman et al. |
| 2002/0077167 | A1 | 6/2002 | Merari |
| 2002/0077170 | A1 | 6/2002 | Johnson et al. |
| 2002/0080969 | A1 | 6/2002 | Giobbi |
| 2002/0086725 | A1 | 7/2002 | Fasbender et al. |
| 2002/0087403 | A1 | 7/2002 | Meyers et al. |
| 2002/0087876 | A1 | 7/2002 | Larose |
| 2002/0094869 | A1 | 7/2002 | Harkham |
| 2002/0107072 | A1 | 8/2002 | Giobbi |
| 2002/0111209 | A1 | 8/2002 | Walker et al. |
| 2002/0116615 | A1 | 8/2002 | Nguyen et al. |
| 2002/0137217 | A1 | 9/2002 | Rowe |
| 2002/0138594 | A1 | 9/2002 | Rowe |
| 2002/0142841 | A1 | 10/2002 | Boushy |
| 2002/0142846 | A1 | 10/2002 | Paulsen |
| 2002/0144116 | A1 | 10/2002 | Giobbi |
| 2002/0147047 | A1 | 10/2002 | Letovsky et al. |
| 2002/0151358 | A1 | 10/2002 | Walker et al. |
| 2002/0151360 | A1 | 10/2002 | Durham et al. |
| 2002/0151363 | A1 | 10/2002 | Letovsky et al. |
| 2002/0160826 | A1 | 10/2002 | Gomez et al. |
| 2002/0169022 | A1 | 11/2002 | Canterbury |
| 2002/0173355 | A1 | 11/2002 | Walker et al. |
| 2002/0174160 | A1 | 11/2002 | Gatto et al. |
| 2002/0174444 | A1 | 11/2002 | Gatto et al. |
| 2002/0177483 | A1 | 11/2002 | Cannon |
| 2002/0183105 | A1 | 12/2002 | Cannon et al. |
| 2002/0188940 | A1 | 12/2002 | Breckner et al. |
| 2003/0003989 | A1 | 1/2003 | Johnson |
| 2003/0027628 | A1 | 2/2003 | Luciano |
| 2003/0027638 | A1 | 2/2003 | Schneider et al. |
| 2003/0028567 | A1 | 2/2003 | Carlson |
| 2003/0036430 | A1 | 2/2003 | Cannon |
| 2003/0045351 | A1 | 3/2003 | Gauselmann |
| 2003/0045354 | A1 | 3/2003 | Giobbi |
| 2003/0054879 | A1 | 3/2003 | Schneier et al. |
| 2003/0060268 | A1 | 3/2003 | Falconer |
| 2003/0060286 | A1 | 3/2003 | Walker et al. |
| 2003/0064771 | A1 | 4/2003 | Morrow et al. |
| 2003/0064772 | A1 | 4/2003 | Tempest et al. |
| 2003/0064807 | A1 | 4/2003 | Walker et al. |
| 2003/0069058 | A1 | 4/2003 | Byrne et al. |
| 2003/0073497 | A1 | 4/2003 | Nelson |
| 2003/0078093 | A1 | 4/2003 | Simms et al. |
| 2003/0078094 | A1 | 4/2003 | Gatto et al. |
| 2003/0078101 | A1 | 4/2003 | Schneider et al. |
| 2003/0083943 | A1 | 5/2003 | Adams et al. |
| 2003/0087689 | A1 | 5/2003 | Adams |
| 2003/0092489 | A1 | 5/2003 | Veradej |
| 2003/0093669 | A1 | 5/2003 | Morais et al. |
| 2003/0100359 | A1 | 5/2003 | Loose et al. |
| 2003/0100369 | A1 | 5/2003 | Gatto et al. |
| 2003/0100370 | A1 | 5/2003 | Gatto et al. |
| 2003/0100371 | A1 | 5/2003 | Gatto et al. |
| 2003/0100372 | A1 | 5/2003 | Gatto et al. |
| 2003/0104855 | A1 | 6/2003 | McClintic |
| 2003/0104865 | A1 | 6/2003 | Itkis et al. |
| 2003/0114218 | A1 | 6/2003 | Haapoja et al. |
| 2003/0114219 | A1 | 6/2003 | McClintic |
| 2003/0115351 | A1 | 6/2003 | Giobbi |
| 2003/0125107 | A1 | 7/2003 | Cannon |
| 2003/0137110 | A1 | 7/2003 | Huard et al. |
| 2003/0139214 | A1 | 7/2003 | Wolf et al. |
| 2003/0140134 | A1 | 7/2003 | Swanson et al. |
| 2003/0144053 | A1 | 7/2003 | Michaelson |
| 2003/0162583 | A1 | 8/2003 | Baerlocher et al. |
| 2003/0162589 | A1 | 8/2003 | Nguyen et al. |
| 2003/0171149 | A1 | 9/2003 | Rothschild |
| 2003/0176219 | A1 | 9/2003 | Manfredi et al. |
| 2003/0181231 | A1 | 9/2003 | Vancura et al. |
| 2003/0186745 | A1 | 10/2003 | Nguyen et al. |
| 2003/0188306 | A1 | 10/2003 | Harris et al. |
| 2003/0190941 | A1 | 10/2003 | Byrne |
| 2003/0190959 | A1 | 10/2003 | Olson |
| 2003/0195033 | A1 | 10/2003 | Gazdic et al. |
| 2003/0195043 | A1 | 10/2003 | Shinners et al. |
| 2003/0203756 | A1 | 10/2003 | Jackson |
| 2003/0216182 | A1 | 11/2003 | Gauselmann |
| 2003/0224852 | A1 | 12/2003 | Walker et al. |
| 2003/0228904 | A1 | 12/2003 | Acres et al. |
| 2003/0228907 | A1 | 12/2003 | Gatto et al. |
| 2003/0228912 | A1 | 12/2003 | Wells et al. |
| 2003/0232650 | A1 | 12/2003 | Beatty |
| 2004/0002379 | A1 | 1/2004 | Parrott et al. |
| 2004/0002381 | A1 | 1/2004 | Alcorn et al. |
| 2004/0002385 | A1 | 1/2004 | Nguyen |
| 2004/0003389 | A1 | 1/2004 | Reynar et al. |
| 2004/0005919 | A1 | 1/2004 | Walker et al. |
| 2004/0010700 | A1 | 1/2004 | Mont |
| 2004/0015423 | A1 | 1/2004 | Walker et al. |
| 2004/0023721 | A1 | 2/2004 | Giobbi |
| 2004/0024666 | A1 | 2/2004 | Walker et al. |
| 2004/0029635 | A1 | 2/2004 | Giobbi |
| 2004/0038723 | A1 | 2/2004 | Schneier et al. |
| 2004/0043815 | A1 | 3/2004 | Kaminkow |
| 2004/0048660 | A1 | 3/2004 | Gentles et al. |
| 2004/0048667 | A1 | 3/2004 | Rowe |
| 2004/0053664 | A1 | 3/2004 | Byrne |
| 2004/0054952 | A1 | 3/2004 | Morrow et al. |
| 2004/0063489 | A1 | 4/2004 | Crumby |
| 2004/0063492 | A1 | 4/2004 | Baerlocher et al. |
| 2004/0070146 | A1 | 4/2004 | Snow |
| 2004/0072604 | A1 | 4/2004 | Toyoda |
| 2004/0072608 | A1 | 4/2004 | Toyoda |
| 2004/0072619 | A1 | 4/2004 | Brosnan et al. |
| 2004/0082385 | A1 | 4/2004 | Silva et al. |
| 2004/0084843 | A1 | 5/2004 | Snow |
| 2004/0087369 | A1 | 5/2004 | Tanaka et al. |
| 2004/0090003 | A1 | 5/2004 | Snow |
| 2004/0090005 | A1 | 5/2004 | Snow |
| 2004/0092310 | A1 | 5/2004 | Brosnan et al. |
| 2004/0098597 | A1 | 5/2004 | Giobbi |
| 2004/0106446 | A1 | 6/2004 | Cannon et al. |
| 2004/0106452 | A1 | 6/2004 | Nguyen et al. |
| 2004/0124243 | A1 | 7/2004 | Gatto et al. |
| 2004/0127279 | A1 | 7/2004 | Gatto et al. |
| 2004/0132532 | A1 | 7/2004 | Brosnan et al. |
| 2004/0133485 | A1 | 7/2004 | Schoonmaker et al. |
| 2004/0137978 | A1 | 7/2004 | Cole et al. |
| 2004/0142739 | A1 | 7/2004 | Loose et al. |
| 2004/0142742 | A1 | 7/2004 | Schneider et al. |
| 2004/0142750 | A1 | 7/2004 | Glisson et al. |
| 2004/0147314 | A1 | 7/2004 | LeMay et al. |
| 2004/0152509 | A1 | 8/2004 | Hornik et al. |
| 2004/0158536 | A1 | 8/2004 | Kowal et al. |

(56) References Cited

U.S. PATENT DOCUMENTS

2004/0162144 A1 8/2004 Loose et al.
2004/0166923 A1 8/2004 Michaelson et al.
2004/0166940 A1 8/2004 Rothschild
2004/0166942 A1 8/2004 Muir
2004/0176162 A1 9/2004 Rothschild
2004/0176167 A1 9/2004 Michaelson et al.
2004/0179701 A1 9/2004 Boyd
2004/0180721 A1 9/2004 Rowe
2004/0180722 A1 9/2004 Giobbi
2004/0185936 A1 9/2004 Block et al.
2004/0192431 A1 9/2004 Singer et al.
2004/0193726 A1 9/2004 Gatto et al.
2004/0198494 A1 10/2004 Nguyen et al.
2004/0198496 A1 10/2004 Gatto et al.
2004/0204232 A1 10/2004 Asher et al.
2004/0204244 A1 10/2004 Rathsack et al.
2004/0209660 A1 10/2004 Carlson et al.
2004/0214622 A1 10/2004 Atkinson
2004/0214627 A1 10/2004 Jordan et al.
2004/0214640 A1 10/2004 Giobbi
2004/0214641 A1 10/2004 Giobbi
2004/0215756 A1 10/2004 VanAntwerp et al.
2004/0219967 A1 11/2004 Giobbi et al.
2004/0219968 A1 11/2004 Fiden et al.
2004/0219983 A1 11/2004 Giobbi
2004/0224770 A1 11/2004 Wolf et al.
2004/0229684 A1 11/2004 Blackburn et al.
2004/0229698 A1 11/2004 Lind et al.
2004/0229699 A1 11/2004 Gentles et al.
2004/0229700 A1 11/2004 Cannon et al.
2004/0235559 A1 11/2004 Brosnan et al.
2004/0235563 A1 11/2004 Blackburn et al.
2004/0242298 A1 12/2004 Inamura et al.
2004/0242303 A1 12/2004 Walker et al.
2004/0242313 A1 12/2004 Munoz
2004/0242328 A1 12/2004 Blackburn et al.
2004/0242329 A1 12/2004 Blackburn et al.
2004/0242330 A1 12/2004 Blackburn et al.
2004/0242331 A1 12/2004 Blackburn et al.
2004/0243848 A1 12/2004 Blackburn et al.
2004/0243849 A1 12/2004 Blackburn et al.
2004/0248642 A1 12/2004 Rothschild
2004/0248645 A1 12/2004 Blackburn et al.
2004/0248646 A1 12/2004 Canterbury
2004/0248651 A1 12/2004 Gagner
2004/0254006 A1 12/2004 Lam et al.
2004/0254013 A1 12/2004 Quraishi et al.
2004/0254014 A1 12/2004 Quraishi et al.
2004/0254954 A1 12/2004 Gatto et al.
2004/0255139 A1 12/2004 Giobbi
2004/0259629 A1 12/2004 Michaelson et al.
2004/0259633 A1 12/2004 Gentles et al.
2004/0259640 A1 12/2004 Gentles et al.
2004/0259643 A1 12/2004 Gentles
2004/0266532 A1 12/2004 Blackburn et al.
2004/0266533 A1 12/2004 Gentles et al.
2005/0003886 A1 1/2005 Englman et al.
2005/0009599 A1 1/2005 Ryan
2005/0009601 A1 1/2005 Manfredi et al.
2005/0009607 A1 1/2005 Russell et al.
2005/0010738 A1 1/2005 Stockdale et al.
2005/0014559 A1 1/2005 Mattice et al.
2005/0032566 A1 2/2005 Baerlocher et al.
2005/0032573 A1 2/2005 Acres et al.
2005/0032577 A1 2/2005 Blackburn et al.
2005/0037708 A1 2/2005 Torvinen
2005/0043072 A1 2/2005 Nelson
2005/0043088 A1 2/2005 Nguyen et al.
2005/0043090 A1 2/2005 Pryzby et al.
2005/0043094 A1 2/2005 Nguyen et al.
2005/0044535 A1 2/2005 Coppert
2005/0049037 A1 3/2005 Anderson et al.
2005/0054419 A1 3/2005 Souza et al.
2005/0054431 A1 3/2005 Walker et al.
2005/0054438 A1 3/2005 Rothschild et al.
2005/0054445 A1 3/2005 Gatto et al.
2005/0054447 A1 3/2005 Hiroyama et al.
2005/0054448 A1 3/2005 Frerking et al.
2005/0059457 A1 3/2005 Rothschild et al.
2005/0059478 A1 3/2005 Peterson et al.
2005/0059493 A1 3/2005 Tyson et al.
2005/0059494 A1 3/2005 Kammler
2005/0064939 A1 3/2005 McSheffrey et al.
2005/0075983 A1 4/2005 St. Denis
2005/0081623 A1 4/2005 Frank
2005/0085288 A1 4/2005 Schugar et al.
2005/0086286 A1 4/2005 Gatto et al.
2005/0090313 A1 4/2005 Rowe
2005/0096114 A1 5/2005 Cannon et al.
2005/0096133 A1 5/2005 Hoefelmeyer et al.
2005/0097342 A1 5/2005 Gatto et al.
2005/0101370 A1 5/2005 Lind et al.
2005/0107158 A1 5/2005 Kanisawa et al.
2005/0107164 A1 5/2005 Muir et al.
2005/0113172 A1 5/2005 Gong
2005/0114272 A1 5/2005 Herrmann et al.
2005/0119045 A1 6/2005 Fujimoto
2005/0119046 A1 6/2005 Fujimoto
2005/0119052 A1 6/2005 Russell et al.
2005/0137012 A1 6/2005 Michaealson
2005/0148378 A1 7/2005 Fasbender et al.
2005/0148385 A1 7/2005 Michaealson
2005/0153778 A1 7/2005 Nelson et al.
2005/0181860 A1 8/2005 Nguyen et al.
2005/0192099 A1 9/2005 Nguyen et al.
2005/0193209 A1 9/2005 Saunders et al.
2005/0221882 A1 10/2005 Nguyen et al.
2005/0233794 A1 10/2005 Cannon et al.
2005/0233803 A1 10/2005 Yang
2005/0239530 A1 10/2005 Walker et al.
2005/0239542 A1 10/2005 Olsen
2005/0261060 A1 11/2005 Nguyen et al.
2005/0261061 A1 11/2005 Nguyen et al.
2005/0282629 A1 12/2005 Gagner
2005/0282638 A1 12/2005 Rowe
2006/0009273 A2 1/2006 Moshal
2006/0019747 A1 1/2006 Loose et al.
2006/0019750 A1 1/2006 Beatty
2006/0025209 A1 2/2006 Walker et al.
2006/0030409 A1 2/2006 Lechner et al.
2006/0031829 A1 2/2006 Harris et al.
2006/0035707 A1 2/2006 Nguyen et al.
2006/0036573 A1 2/2006 Watanabe et al.
2006/0039132 A1 2/2006 Chen
2006/0040732 A1 2/2006 Baerlocher et al.
2006/0040735 A1 2/2006 Baerlocher
2006/0046823 A1 3/2006 Kaminkow et al.
2006/0068875 A1 3/2006 Cregan et al.
2006/0073882 A1 4/2006 Rozkin et al.
2006/0073887 A1 4/2006 Nguyen et al.
2006/0073888 A1 4/2006 Nguyen et al.
2006/0084486 A1 4/2006 Belger et al.
2006/0084502 A1 4/2006 Downs, III et al.
2006/0089194 A1 4/2006 Joshi et al.
2006/0092019 A1 5/2006 Fallon
2006/0094508 A1 5/2006 D'Amico et al.
2006/0111170 A1 5/2006 Hornik et al.
2006/0121972 A1 6/2006 Walker et al.
2006/0128457 A1 6/2006 Cannon
2006/0128460 A1 6/2006 Muir et al.
2006/0135255 A1 6/2006 Roth
2006/0142079 A1 6/2006 Ikehara et al.
2006/0143085 A1 6/2006 Adams et al.
2006/0148547 A1 7/2006 Montgomery et al.
2006/0154722 A1 7/2006 Walker et al.
2006/0165235 A1 7/2006 Carlson
2006/0194633 A1 8/2006 Paulsen
2006/0211473 A1 9/2006 Walker et al.
2006/0211479 A1 9/2006 Walker et al.
2006/0211480 A1 9/2006 Walker et al.
2006/0217170 A1 9/2006 Roireau
2006/0217171 A1 9/2006 Roireau
2006/0217172 A1 9/2006 Roireau
2006/0217176 A1 9/2006 Walker et al.

(56) References Cited

U.S. PATENT DOCUMENTS

2006/0252546 A1 9/2006 Castellari et al.
2006/0223613 A1 10/2006 Walker et al.
2006/0223636 A1 10/2006 Walker et al.
2006/0240887 A1 10/2006 Walker et al.
2006/0240889 A1 10/2006 Walker et al.
2006/0240892 A1 10/2006 Walker et al.
2006/0246983 A1 11/2006 Huard et al.
2006/0247010 A1 11/2006 Gagner
2006/0247011 A1 11/2006 Gagner
2006/0247012 A1 11/2006 Walker et al.
2006/0247029 A1 11/2006 Walker et al.
2006/0252508 A1 11/2006 Walker et al.
2006/0252523 A1 11/2006 Walker et al.
2006/0258446 A1 11/2006 Nguyen et al.
2006/0264256 A1 11/2006 Gagner et al.
2006/0287107 A1 11/2006 Okada
2006/0287098 A1 12/2006 Morrow et al.
2007/0004509 A1 1/2007 Banton
2007/0054726 A1 3/2007 Muir et al.
2007/0060314 A1 3/2007 Baerlocher et al.
2007/0060321 A1 3/2007 Vasquez et al.
2007/0077990 A1 4/2007 Cuddy et al.
2007/0102877 A1 5/2007 Personius et al.
2007/0135215 A1 6/2007 Walker et al.
2007/0155482 A1 7/2007 Walker et al.
2007/0155483 A1 7/2007 Walker et al.
2007/0155484 A1 7/2007 Walker et al.
2007/0167211 A1 7/2007 Rodgers et al.
2007/0191088 A1 8/2007 Breckner et al.
2007/0202941 A1 8/2007 Miltenberger et al.
2007/0232392 A1 10/2007 Pace
2007/0232397 A1 10/2007 Katz
2007/0243925 A1 10/2007 LeMay et al.
2007/0259709 A1 11/2007 Kelly et al.
2007/0265094 A1 11/2007 Tone et al.
2007/0273097 A1 11/2007 Kirkutis
2007/0293293 A1 12/2007 Baerlocher et al.
2007/0293306 A1 12/2007 Nee et al.
2007/0298857 A1 12/2007 Schlottmann et al.
2007/0298874 A1 12/2007 Baerlocher et al.
2007/0298875 A1 12/2007 Baerlocher et al.
2008/0009334 A1 1/2008 Walker et al.
2008/0020830 A1 1/2008 Ikehara et al.
2008/0020831 A1 1/2008 Ikehara et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0026840 A1 1/2008 Souza et al.
2008/0045344 A1 2/2008 Schlottmann et al.
2008/0064501 A1 3/2008 Patel
2008/0064502 A1 3/2008 Schlottmann et al.
2008/0067745 A1 3/2008 Wikstrom
2008/0070680 A1 3/2008 Baerlocher et al.
2008/0070692 A1 3/2008 Schlottmann et al.
2008/0070693 A1 3/2008 Schlottmann et al.
2008/0070694 A1 3/2008 Schlottmann et al.
2008/0070695 A1 3/2008 Baerlocher et al.
2008/0070702 A1 3/2008 Kaminkow et al.
2008/0076496 A1 3/2008 Baerlocher et al.
2008/0076514 A1 3/2008 Baerlocher et al.
2008/0076515 A1 3/2008 Baerlocher et al.
2008/0076517 A1 3/2008 Baerlocher et al.
2008/0076531 A1 3/2008 Baerlocher et al.
2008/0076532 A1 3/2008 Graham et al.
2008/0076542 A1 3/2008 Iddings et al.
2008/0076547 A1 3/2008 Bigelow et al.
2008/0076552 A1 3/2008 Baerlocher et al.
2008/0102916 A1 5/2008 Kovacs et al.
2008/0102934 A1 5/2008 Tan
2008/0108401 A1 5/2008 Baerlocher et al.
2008/0108425 A1 5/2008 Oberberger
2008/0146344 A1 6/2008 Rowe et al.
2008/0153588 A1 6/2008 Muir et al.
2008/0176635 A1 7/2008 Randall
2008/0182650 A1 7/2008 Randall et al.
2008/0220839 A1 9/2008 DeBrabander
2009/0042644 A1 2/2009 Zielinski
2009/0042645 A1 2/2009 Graham et al.
2009/0111574 A1 4/2009 Rowe
2009/0117993 A1 5/2009 Bigelow et al.
2009/0203422 A1 8/2009 Ellis
2009/0209333 A1 8/2009 Kelly et al.
2009/0239631 A1* 9/2009 Aoki ..... G07F 17/34 463/20
2009/0325686 A1 12/2009 Davis et al.
2010/0016062 A1 1/2010 Baerlocher
2010/0062196 A1 3/2010 Bezek et al.
2010/0069160 A1 3/2010 Barrett et al.
2010/0081509 A1 4/2010 Burke et al.
2010/0106823 A1 4/2010 Davis et al.
2010/0120506 A1 5/2010 Davis et al.
2010/0203960 A1 8/2010 Wilson et al.
2010/0210353 A1 8/2010 Gagner
2010/0234097 A1 9/2010 Gelber et al.
2010/0234099 A1 9/2010 Rasmussen et al.
2010/0248821 A1 9/2010 Jorasch et al.
2010/0255912 A1 10/2010 Ward
2010/0261521 A1 10/2010 Oatman et al.
2010/0285860 A1 11/2010 Svanas
2010/0285865 A1 11/2010 Enzminger
2010/0298040 A1 11/2010 Joshi et al.
2011/0045892 A1 2/2011 Vann et al.
2011/0092288 A1 4/2011 Pryzby et al.
2011/0111842 A1 5/2011 Walker et al.
2011/0218034 A1 9/2011 Barclay et al.
2011/0223686 A1 9/2011 Little
2011/0287828 A1 11/2011 Anderson et al.
2012/0042000 A1 2/2012 Heins et al.
2012/0046110 A1 2/2012 Amaitis et al.
2012/0058814 A1 3/2012 Lutnick et al.
2012/0122547 A1* 5/2012 Aoki ..... G07F 17/34 463/20
2012/0122550 A1 5/2012 Johnson et al.
2012/0172106 A1 7/2012 Caputo et al.
2012/0172123 A1 7/2012 Beaulieu et al.
2012/0202592 A1 8/2012 Sprinkle
2013/0157741 A1* 6/2013 Pacey ..... G07F 17/3265 463/20
2013/0165211 A1 6/2013 Graham et al.
2013/0303260 A1* 11/2013 Louie ..... G07F 17/34 463/21
2014/0256402 A1 9/2014 Caputo et al.
2014/0274295 A1* 9/2014 Poole ..... G07F 17/326 463/20
2015/0087393 A1* 3/2015 Jaffe ..... G07F 17/34 463/20

FOREIGN PATENT DOCUMENTS

AU 2005251830 12/2005
AU 2002310115 6/2006
CA 2270062 10/1999
CA 2285752 4/2000
DE 4446139 7/1995
DE 19640860 4/1998
EP 0655265 5/1995
EP 829834 3/1998
EP 0843272 5/1998
EP 0945837 9/1999
EP 1004970 5/2000
EP 1063622 12/2000
EP 1231577 8/2002
EP 1363252 11/2003
EP 1199690 2/2004
EP 1463008 9/2004
EP 1469436 10/2004
EP 0813132 1/2005
EP 1378873 3/2005
EP 1238688 5/2005
EP 1378874 5/2005
EP 1471710 5/2005
EP 1291048 6/2005

(56) References Cited

FOREIGN PATENT DOCUMENTS

| | | | |
|---|---|---|---|
| EP | 1 610 275 | | 12/2005 |
| GB | 1242298 | | 8/1971 |
| GB | 2100905 | | 6/1981 |
| GB | 2106293 | | 9/1981 |
| GB | 2090690 | | 7/1982 |
| GB | 2096376 | | 10/1982 |
| GB | 2097160 | | 10/1982 |
| GB | 2098778 | | 11/1982 |
| GB | 2117952 | | 10/1983 |
| GB | 2137392 | | 10/1984 |
| GB | 2144644 | | 3/1985 |
| GB | 2153572 | | 8/1985 |
| GB | 2157047 | | 10/1985 |
| GB | 2 161 008 | | 1/1986 |
| GB | 2170636 | | 8/1986 |
| GB | 2180682 | | 4/1987 |
| GB | 2181589 | | 4/1987 |
| GB | 2183882 | | 6/1987 |
| GB | 2191030 | | 12/1987 |
| GB | 2222712 | | 3/1990 |
| GB | 2225889 | | 6/1990 |
| GB | 2226436 | | 6/1990 |
| GB | 2242300 | | 9/1991 |
| JP | 07148307 | | 6/1995 |
| WO | WO 95/19595 | | 7/1995 |
| WO | WO 95/24796 | | 9/1995 |
| WO | WO 1996/009102 | | 3/1996 |
| WO | WO 96/11730 | | 4/1996 |
| WO | WO 97/12338 | | 4/1997 |
| WO | WO9719736 | | 6/1997 |
| WO | WO 97/27568 | | 7/1997 |
| WO | WO 9727570 | | 7/1997 |
| WO | WO 98/35309 | | 8/1998 |
| WO | WO 98/56475 | | 12/1998 |
| WO | WO 99/10849 | | 3/1999 |
| WO | WO 9941718 | | 8/1999 |
| WO | WO 9965579 | | 12/1999 |
| WO | WO 00/12186 | | 3/2000 |
| WO | WO0025281 | | 5/2000 |
| WO | WO00/32286 | | 6/2000 |
| WO | WO01/82245 | A2 | 1/2001 |
| WO | WO0161437 | | 8/2001 |
| WO | WO01/91866 | | 12/2001 |
| WO | WO0222225 | | 3/2002 |
| WO | WO03/041825 | | 5/2002 |
| WO | WO 02/099760 | A2 | 12/2002 |
| WO | WO 03/028830 | | 4/2003 |
| WO | WO 03045515 | | 6/2003 |
| WO | WO 03045516 | | 6/2003 |
| WO | WO04004855 | | 1/2004 |
| WO | WO 2004/034223 | | 4/2004 |
| WO | WO 04103495 | | 12/2004 |
| WO | WO 05028056 | | 3/2005 |
| WO | WO 05029220 | | 3/2005 |
| WO | WO 02/32526 | | 4/2005 |
| WO | WO 05033825 | | 4/2005 |
| WO | WO 05033826 | | 4/2005 |
| WO | WO 2005/079242 | A2 | 9/2005 |
| WO | WO 2005/120672 | | 12/2005 |
| WO | WO 06027677 | | 3/2006 |
| WO | WO 06039067 | | 4/2006 |
| WO | WO 2006/076185 | | 7/2006 |
| WO | WO 2007/089410 | | 9/2007 |
| WO | WO 07103054 | | 9/2007 |
| WO | WO 2007/139988 | | 12/2007 |
| WO | WO 2008/030904 | | 3/2008 |
| WO | WO 2008/060426 | | 5/2008 |
| WO | WO 2008/060442 | | 5/2008 |
| WO | WO 2008/060459 | | 5/2008 |
| WO | WO 2008/060513 | | 5/2008 |
| WO | WO 2008/063408 | | 5/2008 |

OTHER PUBLICATIONS

Traditional Game Integration vs. IGT RGS Games Integration, published by IGT, printed prior to Sep. 28, 2011.

Bally Live-Server Based Gaming brochure, written by Bally Gaming Systems, published in 2006.

Bonusing Solutions without Limits brochure, written by Bally Gaming Systems, published in 2005.

SB Products—The Next Big Innovation, printed from www.igt.com in Aug. 2006.

Server Based: Other Possibilities Article; published by www.casinocenter.com in May 2006.

Transferring Gaming brochure, written by Cyberview Technology, published in 2006.

* cited by examiner

GAMING SYSTEM AND METHOD EMPLOYING MULTI-DIRECTIONAL INTERACTION BETWEEN MULTIPLE CONCURRENTLY PLAYED GAMES

PRIORITY CLAIM

This application claims priority to and the benefit of U.S. Provisional Patent Application No. 62/028,625, filed on Jul. 24, 2014, the entire contents of which is incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate a primary or base game. Certain known gaming machines enable a player to wager on and play a plurality of primary or base games simultaneously or concurrently. In many of these gaming machines, the award for each played primary game is based on the player obtaining a winning symbol or symbol combination and on the amount of the wager placed on that primary game (e.g., the higher the wager, the higher the award). Generally, symbols or symbol combinations which are less likely to occur usually provide higher awards.

Various known gaming machines enable players to play more than one wagering game simultaneously. Certain of these gaming machines enable players to play multiple plays of a same wagering game simultaneously, plays of different wagering games simultaneously, or both.

There is a continuing need to provide new and different gaming systems and methods which incorporate new and different ways to play multiple games concurrently.

SUMMARY

The present disclosure relates generally to gaming systems and methods employing multi-directional interaction between multiple concurrently played game.

In various embodiments, the gaming system disclosed herein includes a plurality of concurrent or overlapping game plays. Each concurrent or overlapping game play is associated with or otherwise configured to activate zero, one or more features. In these embodiments, following any activation of one or more features of at least one of the concurrent or overlapping game plays, the gaming system causes such activated features (or features associated with such activated features) to also be activated in one or more of the other concurrent or overlapping game plays. Such a transfer or replication of activated features occurs independent of which specific game play such features were activated initially for. That is, one or more activated features from any of the concurrent or overlapping game plays may be transferred to one, more or any of the other concurrent or overlapping game plays to facilitate an increased interaction between the concurrent or overlapping game plays. In these embodiments, for each of the concurrently or overlappingly played games, the gaming system determines an award for that played game, wherein the award is based, at least in part, on any activated features for that game play. Such a configuration of multi-directionally transferring features amongst a plurality of different concurrently or overlappingly played games increases the level of excitement and enjoyment for certain players by increasing the quantity of award opportunities for such players.

In operation of various embodiments, upon an occurrence of a concurrent or overlapping game play triggering event, such as a player placing a wager on each of a plurality of games, the gaming system triggers a plurality of concurrent or overlapping game plays. For one or more of the triggered concurrent or overlapping game plays, the gaming system determines and display an outcome. For such triggered game plays, the gaming system also activates zero, one or more features and transfers zero, one or more of any activated features to zero, one or more of the other concurrent or overlapping game plays. In one such embodiment, for one or more of the triggered game plays, the activated feature of that game play is associated with or otherwise based on the determined outcome for that game play. For example, a wild symbol determined and displayed in a symbol display position for one triggered game play qualifies as an activated feature to be transferred to one or more other triggered game plays. As such, in certain embodiments, a determined outcome for one game play is associated with or otherwise causes one or more features to be activated in one or more other game plays.

Following the transfer or replication of zero, one or more activated features to zero, one or more of the other concurrent or overlapping game plays and any activation of any non-transferred features for any of the other concurrent or overlapping game plays, the gaming system determines and displays an outcome for such other game plays. In this embodiment, the gaming system determines the outcome for such other game plays based, at least in part, on any features transferred to that game play from any other game plays. For example, if three game plays are concurrently or overlappingly triggered and the gaming system determines, for a first of the game plays, that the determined outcome for that game play includes a wild symbol (i.e., the activated feature of a wild symbol), the gaming system transfers that wild symbol to a second of the game plays. The gaming system of this example then determines, based at least in part on the transferred wild symbol, an outcome for that second of the game plays.

Following the determination of such outcomes, the gaming system proceeds with transferring zero, one or more features of one game play to zero, one or more of the other concurrent or overlapping game plays and determining zero, one or more outcomes (based at least in part on any features transferred to that game). Continuing with the above example, if the gaming system determines, for the second of the game plays, that the determined outcome for that game play includes a wild modifier symbol (i.e., the activated feature of a wild modifier symbol), the gaming system transfers that wild modifier symbol to a third of the game plays. The gaming system of this example then determines, based at least in part on the transferred wild modifier symbol, an outcome for the third of the game plays.

In addition to activating one or more features in zero, one or more concurrently or overlappingly played games based on any features activated in other concurrently or overlappingly played game, the gaming system determines if a feature transfer termination event occurs. In one such embodiment, a feature transfer termination event occurs when the gaming system determines that: (i) an outcome has been determined for each of the concurrently or overlappingly played games, and (ii) no additional features may be transferred to any more of the concurrently or overlappingly played games. In another such embodiment, a feature transfer termination event occurs when the gaming system determines that the most lucrative activated feature of any of the concurrently or overlappingly played games is transferred to each of the concurrently or overlappingly played games. Continuing with the above example, since the wild modifier feature currently activated in the second game play and the third game play is a more lucrative feature than the wild feature activated in the first game play, the gaming system transfers the wild modifier feature from the second game play to the first game play. The gaming system of this example then determines that a feature transfer termination event occurs (i.e., the most lucrative activated feature of any of the concurrently or overlappingly played games is transferred to each of the concurrently or overlappingly played games). In these embodiments, upon the occurrence of a feature transfer termination event, for each of the concurrent or overlapping game plays, the gaming system displays any awards associated with the displayed outcome of that game play.

Accordingly, by individually determining, for each triggered simultaneous or overlappingly game play, whether to transfer one or more activated features of that game to zero, one or more of the other simultaneous or overlappingly game plays, the gaming system of the present disclosure employs a multi-directional feature transfer which benefits players by providing greater awards to such players.

Additional features and advantages are described herein, and will be apparent from the following Detailed Description and the figures.

DETAILED DESCRIPTION

Overlapping Primary Game Plays with Multi-Directional Feature Transfers

In various embodiments, the gaming system disclosed herein includes a plurality of concurrent or overlapping game plays. Each concurrent or overlapping game play is associated with or otherwise configured to activate zero, one or more features. In these embodiments, following any activation of one or more features of at least one of the concurrent or overlapping game plays, the gaming system causes such activated features (or features associated with such activated features) to also be activated in one or more of the other concurrent or overlapping game plays. Such a transfer or replication of activated features occurs independent of which specific game play such features were activated initially for. That is, one or more activated features from any of the concurrent or overlapping game plays may be transferred to one, more or any of the other concurrent or overlapping game plays to facilitate an increased interaction between the concurrent or overlapping game plays. In these embodiments, for each of the concurrently or overlappingly played games, the gaming system determines an award for that played game, wherein the award is based, at least in part, on any activated features for that game play. Such a configuration of multi-directionally transferring features amongst a plurality of different concurrently or overlappingly played games increases the level of excitement and enjoyment for certain players by increasing the quantity of award opportunities for such players.

While certain of the embodiments described below are directed to playing the simultaneous, concurrent or overlapping games as simultaneous, concurrent or overlapping primary or base games, it should be appreciated that the present disclosure may additionally or alternatively be employed with a plurality of simultaneous, concurrent or overlapping secondary or bonus games. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
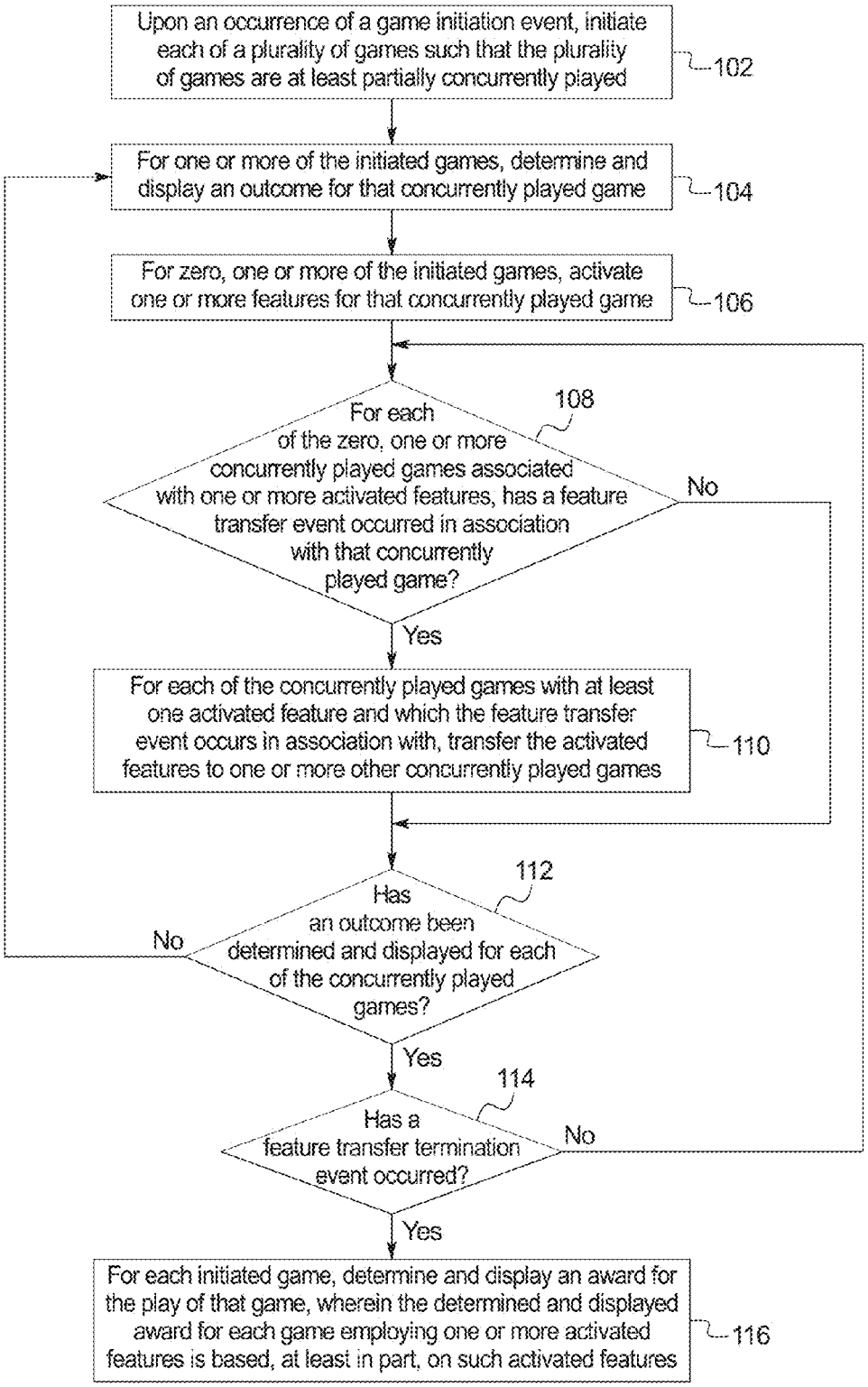
FIG. 1 is a flow chart an example process for operating a gaming system including a plurality of simultaneous or overlapping game plays wherein one or more features are multi-directionally transferred between the simultaneous or overlapping game plays as disclosed herein.

Referring now to FIG. 1, a flowchart of an example embodiment of a process for operating a gaming system disclosed herein is illustrated. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain steps described may be changed, or certain steps described may be optional.

In various embodiments, upon an occurrence of a game initiation event, the gaming system initiates each of a plurality of games such that the plurality of games are at least partially concurrently played as indicated in block 102.

In one embodiment wherein the games are primary games, a game initiation event occurs upon a player placing one or more wagers on one or more of a plurality of available games. In one embodiment, the gaming system enables the player to place the same wager amount on each of the games. In another embodiment, the gaming system enables the player to wager different wager amounts on two or more of the games. It should be appreciated that by enabling the player to select which games to play (via placing one or more wagers) and select which games not to play (via not placing any wagers), the gaming system enables the player to customize the game configuration associated with a plurality of simultaneous, concurrent or overlapping played games.

In one embodiment wherein the games are secondary games, the gaming system causes a game initiation event to occur independent of any displayed events associated with any plays of any games. In another embodiment wherein the games are secondary games, the gaming system causes a game initiation event to occur based on (or as a result of) one or more displayed events occurring in association with one or more plays of one or more games. In another embodiment wherein the games are secondary games, the gaming system tracks the occurrences of one or more suitable events occurring at or in association with one or more players and/or one or more games and determines, based on these tracked events, whether a game initiation event occurs. In another embodiment wherein the games are secondary games, the gaming system defines one or more game play parameters, such as a wager amount or a maximum wager amount, wherein the gaming system determines whether a game initiation event occurs based on a player's tracked game play activity satisfying the defined parameter.

In one embodiment, the gaming system initiates each of the plurality of games simultaneously, substantially simultaneously or overlappingly. In another embodiment, the gaming system initiates two or more of the plurality of games simultaneously or substantially simultaneously and initiates (but does not complete) two of more of the plurality of games sequentially or substantially sequentially. In another embodiment, the gaming system initiates (but does not complete) each of the plurality of games sequentially.

In certain embodiments, two or more of these plurality of games are different games. In certain embodiments, each of the plurality of games are different games. In these embodiments, at least two or more of the games are different game types, have different game themes, and/or different game styles. In other embodiments, at least two or more of the plurality of games utilize different sets of available symbols. In another embodiment, at least two or more of the different games utilize different paytables. In another embodiment, at least two or more of the different games are associated with different average expected payback percentages.

After initiating each of the plurality of games such that the plurality of games are at least partially concurrently played, as indicated in block 104, for one or more of the initiated games, the gaming system determines and displays an outcome for that concurrently played game.

In addition to determining and displaying an outcome for one or more of the currently played games, as indicated in block 106, for zero, one or more of the initiated games, the gaming system activates one or more features for that concurrently played game.

In one embodiment, one, more, or each of the initiated games are associated with or otherwise configured to activate one or more features. In this embodiment, one or more of the initiated games each employ different features or attributes or otherwise have different characteristics. In one embodiment, at least two of the games are associated with or otherwise configured to activate different features. In another embodiment, each of the games are associated with or otherwise configured to activate different features. In another embodiment, at least two of the games are associated with or otherwise configured to activate the same features. In another embodiment, each of the games are associated with or otherwise configured to activate the same features.

In one embodiment, the gaming system activates one or more features of one or more concurrently played games based on (or as a result of) one or more displayed events occurring in association with one or more plays of one or more games. In one such embodiment, for one or more of the concurrently played games, an outcome determined for that game play (or one or more components of the outcome determined for that game play) qualifies as the activation of one or more features. For example, if the gaming system sequentially displays the outcomes for at least two of the concurrently played games and one of the displayed outcomes includes a wild symbol (i.e., a game component of the displayed outcome), such a displayed wild symbol qualifies as the activation of a wild symbol feature.

In another embodiment, the gaming system activates one or more features of one or more concurrently played games independent of any displayed events associated with any plays of any games. In another embodiment, the gaming system tracks the occurrences of one or more suitable events occurring at or in association with one or more players and/or one or more games and determines, based on these tracked events, whether to activate one or more features of one or more concurrently played games. In another embodiment, the gaming system defines one or more game play parameters, such as a wager amount or a maximum wager amount, wherein the gaming system determines whether to activate one or more features of one or more concurrently played games based on a player's tracked game play activity satisfying the defined parameter.

In various embodiments, one or more features activated for zero, one or more of the concurrently played games include, but are not limited to:

i. a wild symbols feature;
ii. a book-end wild symbols feature;
iii. a stacked wild symbols feature;
iv. an expanding wild symbols feature;
v. a wild reel feature;
vi. a retrigger symbol feature;
vii. an anti-terminator symbol feature;
viii. a locking reel feature,
ix. a locking symbol position feature;
x. a modifier, such as a multiplier, feature;
xi. a modification of an amount of credits of a credit balance;
xii. a modification of an amount of promotional credits;
xiii. a modification of a placed wager amount;
xiv. a modification of a wager amount available to be placed;
xv. a modification of a placed side wager amount;
xvi. a modification of a side wager amount available to be placed;
xvii. a modification of a rate of earning player tracking points;
xviii. a modification of a number of wagered on paylines;
xix. a modification of a number of paylines available to be wagered on;
xx. a modification of a wager placed on one or more paylines (or on one or more designated paylines);
xxi. a modification of a number of ways to win wagered on;
xxii. a modification of a number of available ways to win to be wagered on;
xxiii. a modification of a wager placed on one or more ways to win (or on one or more designated ways to win);
xxiv. a modification of a paytable utilized for a play of a game;
xxv. an application of a modifier, such as a multiplier or an additional quantity of credits, to one or more awards of a paytable utilized for a play of a game,
xxvi. a modification of an average expected payback percentage of a play of a game;
xxvii. a modification of an average expected payout of a play of a game;

xxviii. a modification of one or more awards available;
xxix. a modification of a range of awards available;
xxx. a modification of a type of awards available;
xxxi. a modification of one or more progressive awards;
xxxii. a modification of which progressive awards are available to be won;
xxxiii. a modification of one or more modifiers, such as multipliers, available;
xxxiv. a modification of an activation of a reel (or a designated reel);
xxxv. a modification of an activation of a plurality of reels;
xxxvi. a modification of a generated outcome (or a designated generated outcome);
xxxvii. a modification of a generated outcome (or a designated generated outcome) associated with an award over a designated value;
xxxviii. a modification of a generated outcome (or a designated generated outcome) on a designated payline;
xxxix. a modification of a generated outcome (or a designated generated outcome) in a scatter configuration;
xl. a modification of a winning way to win (or a designated winning way to win);
xli. a modification of a designated symbol or symbol combination;
xlii. a modification of a generation of a designated symbol or symbol combination on a designated payline;
xliii. a modification of a generation of a designated symbol or symbol combination in a scatter configuration;
xliv. a modification of a triggering event of a play of a secondary or bonus game;
xlv. a modification of an activation of a secondary or bonus display (such as an award generator);
xlvi. a modification of a quantity of activations of a secondary or bonus display (e.g., a modification of a quantity of spins of an award generator);
xlvii. a modification of a quantity of sections of a secondary or bonus display (e.g., a modification of a quantity of sections of an award generator);
xlviii. a modification of one or more awards of a secondary or bonus display;
xlix. a modification of an activation of a community award generator;
l. a modification of a quantity of activations of a community award generator;
li. a modification of a quantity of sections of a community award generator;
lii. a modification of one or more awards of a community award generator;
liii. a modification of a generated outcome (or a designated generated outcome) in a secondary game;
liv. a modification of a quantity of picks in a selection game;
lv. a modification of a quantity of offers in an offer and acceptance game;
lvi. a modification of a quantity of moves in a trail game;
lvii. a modification of an amount of free spins provided;
lviii. a modification of a game terminating or ending condition;
lix. a modification of how one or more aspects of one or more games (e.g., colors, speeds, sound) are displayed to a player;
lx. a modification of access to different websites a player may access via a mobile device;
lxi. a modification of audio-visual content a player may access via a mobile device;
lxii. a modification of a player's avatar; and/or
lxiii. a modification of any game play feature associated with any play of any game disclosed herein.

Following the activation of zero, one or more features for zero, one or more concurrently played games, as indicated in diamond 108 of FIG. 1, for each of the zero, one or more concurrently played games associated with one or more activated features, the gaming system determines if a feature transfer event occurred in association with that concurrently played game.

In one embodiment, a feature transfer event occurs based on (or as a result of) one or more displayed events occurring in association with one or more plays of one or more games. In one such embodiment, for one or more of the concurrently played games, an outcome determined for that game play (or one or more components of the outcome determined for that game play) determines if a feature transfer event occurs. For example, if the gaming system sequentially displays the outcomes for at least two of the concurrently played games and one of the displayed outcomes includes a wild symbol (i.e., an activation of a wild symbol feature), such a displayed wild symbol causes a feature transfer event to occur.

In another embodiment, a feature transfer event occurs independent of any displayed events associated with any plays of any games. In another embodiment, the gaming system tracks the occurrences of one or more suitable events occurring at or in association with one or more players and/or one or more games and determines, based on these tracked events, whether a feature transfer event occurs. In another embodiment, the gaming system defines one or more game play parameters, such as a wager amount or a maximum wager amount, wherein the gaming system determines whether a feature transfer event occurs based on a player's tracked game play activity satisfying the defined parameter.

If a feature transfer event occurs in association with any of the zero, one or more concurrently played games associated with one or more activated features, as indicated in block 110, for each of the concurrently played games with at least one activated feature and which the feature transfer event occurs in association with, the gaming system transfers the activated features to one or more other concurrently played games. In various embodiments, the gaming system transfers or replicates activated features to and from different concurrently played games without regard to which game play a feature was activated in association with and from which game play a feature is transferred to. In such embodiments, one or more features of one or more of the concurrently played games are transferred independent of the origin of one or more activated features and/or the destination of one or more activated features. Such a configuration of multi-directionally transferring features amongst a plurality of different concurrently or overlappingly played games increases the level of excitement and enjoyment for certain players by increasing the quantity of award opportunities for such players.

In one embodiment, for each of the concurrently played games with at least one activated feature, the gaming system transfers the activated features to a plurality of the other concurrently played games. In another embodiment, for each of the concurrently played games with at least one activated feature, the gaming system transfers the activated features to each of the other concurrently played games.

In one embodiment, two or more of the concurrently played games are linked or otherwise associated with each other. In one such embodiment, the gaming system transfers the activated feature of one concurrently played game to one or more of the other linked or otherwise associated with game plays. In another such embodiment, the gaming system transfers the activated feature of one concurrently played game to each of the other linked or otherwise associated with game plays.

In one embodiment, each of the other game plays have the same probability of being transferred an activated feature. In another embodiment, at least two of the game plays have different probabilities of being transferred an activated feature. In another embodiment, each of the game plays have a different probability of being transferred an activated feature. In one embodiment, the gaming system employs a weighted table to select which game play to transfer an activated feature to. In another embodiment, the gaming system employs one or more game selection sequences to select which game play to transfer an activated feature to. In one such embodiment, a game selection sequence includes a game selection generator, such as a wheel with each of the different available games indicated in a different section of the wheel. In this embodiment, the game selection generator spins and the game(s) indicated by one or more stopped indicators determines which game play to transfer an activated feature to. In another such embodiment, a game selection sequence includes a plurality of selections wherein each of the selections is associated with one of the different available games. In this embodiment, the gaming system enables the player to pick one or more selections wherein the gaming system transfers an activated feature to each game play associated with the player's picked selections. In certain embodiments, which game play to transfer an activated feature to is based on a weighted probability table. It should be appreciated that any suitable game selection sequence, such as any suitable game described herein, may be employed in association with determining which game play to transfer an activated feature to.

In one embodiment, the gaming system transfers the activated feature to one or more other concurrently played games based on an outcome determined for one or more of the concurrent game plays (or one or more components of the outcome determined for one or more concurrent game plays). In one such embodiment, one or more outcomes displayed for one or more game plays (or one or more components of such outcomes) are each associated with one or more other game plays. In this embodiment, if such an outcome is displayed for one concurrently played game and at least one feature is activated for that played game, the gaming system transfers the activated features to one, more or each of the other game plays associated with the displayed outcome. For example, if the gaming system sequentially displays the outcomes for at least two of the concurrently played games and one of the displayed outcomes includes a wild symbol associated with two of the other game plays (i.e., an activation of a wild symbol feature associated with two other game plays), such a displayed wild symbol causes the activated wild symbol feature to be transferred to each of the two other game plays associated with the displayed wild symbol.

Following the occurrence of the feature transfer event (and the subsequent transfer of any activated feature to any of the other concurrently played game) or if the gaming system determines that no feature transfer event occurred, the gaming system determines if an outcome has been determined and displayed for each of the concurrently played games as indicated in diamond 112 of FIG. 1.

If an outcome has not yet been determined and displayed for each of the concurrently played games, the gaming system returns to block 104 and determines and displays an outcome for one or more of the initiated games which have not yet determined and displayed an outcome. On the other hand, if an outcome has been determined and displayed for each of the concurrently played games, the gaming system determines if a feature transfer termination event has occurred as indicated in diamond 114 of FIG. 1.

In one embodiment, a feature transfer termination event occurs based on one or more previous feature transfers which occurred. In one such embodiment, the gaming system is associated with a designated quantity of feature transfers and when that quantity of feature transfers has occurred, the gaming system causes the feature transfer termination event to occur. In another embodiment, a feature transfer termination event occurs based on one or more potential feature transfers which may occur. In one such embodiment, the gaming system determines if any more features may be transferred to any other concurrently played games. In this embodiments, if the gaming system determines no more features may be transferred to any other played games, the gaming system causes the feature transfer termination event to occur. For example, if the gaming system determines that a designated feature (e.g., the activated feature amongst each of the concurrently played games that has the highest average expected payout) has already been transferred to each of the played games, the gaming system causes a feature transfer termination event to occur.

In another embodiment, a feature transfer termination event occurs based on (or as a result of) one or more displayed events occurring in association with one or more plays of one or more games. In one such embodiment, if the gaming system determines that an outcome has been determined and displayed for each of the concurrently played games and no more activated features of any of such games qualify to be transferred, the gaming system causes a feature transfer termination event to occur.

In another embodiment, a feature transfer termination event occurs independent of any displayed events associated with any plays of any games. For example, the feature transfer termination event occurs after a designated period of time. In another embodiment, the gaming system tracks the occurrences of one or more suitable events occurring at or in association with one or more players and/or one or more games and determines, based on these tracked events, whether a feature transfer termination event occurs. In another embodiment, the gaming system defines one or more game play parameters, such as a wager amount or a maximum wager amount, wherein the gaming system determines whether a feature transfer termination event occurs based on a player's tracked game play activity satisfying the defined parameter.

If the gaming system determines that no feature transfer termination event occurred, the gaming system returns to diamond 108 and determines, for each of the zero, one or more concurrently played games associated with one or more activated features, if a feature transfer event occurred in association with that concurrently played game.

On the other hand, if the gaming system determines that a feature transfer termination event occurred, as indicated in block 116, for each initiated game, the gaming system determines and displays an award for the play of that game. As further indicated in block 116, for each game employing one or more activated features, the gaming system determines and displays the award for that game accounting for such activated features. That is, for each of the concurrently played games with at least one activated feature (i.e., a feature activated upon an occurrence of a feature activation event for that game play and/or an activated feature transferred to that game play from another concurrent game play), the gaming system utilizes such activated features to determine, at least in part, an amount of the award for each of such concurrently played games. Accordingly, by individually determining, for each triggered simultaneous or overlappingly game play, whether to transfer one or more activated features of that game to zero, one or more of the other simultaneous or overlappingly game plays, the gaming system of the present disclosure employs a multi-directional feature transfer which benefits players by providing greater awards to such players.

It should be appreciated that while the gaming system employs zero, one or more transferred features from one concurrently played game in determining the award for zero, one or more other concurrently played games, the gaming system independently determines the individual game outcome (and individual award) for each of the individually played games.

In one embodiment, the gaming system triggers each of the plurality of games simultaneously or substantially simultaneously but completes two or more of the plurality of games sequentially or substantially sequentially. In one such embodiment, as the gaming system activates one or more features in one of the concurrent game plays, the gaming system sequentially transfers such activated features to the other game plays.

Figure 2A:
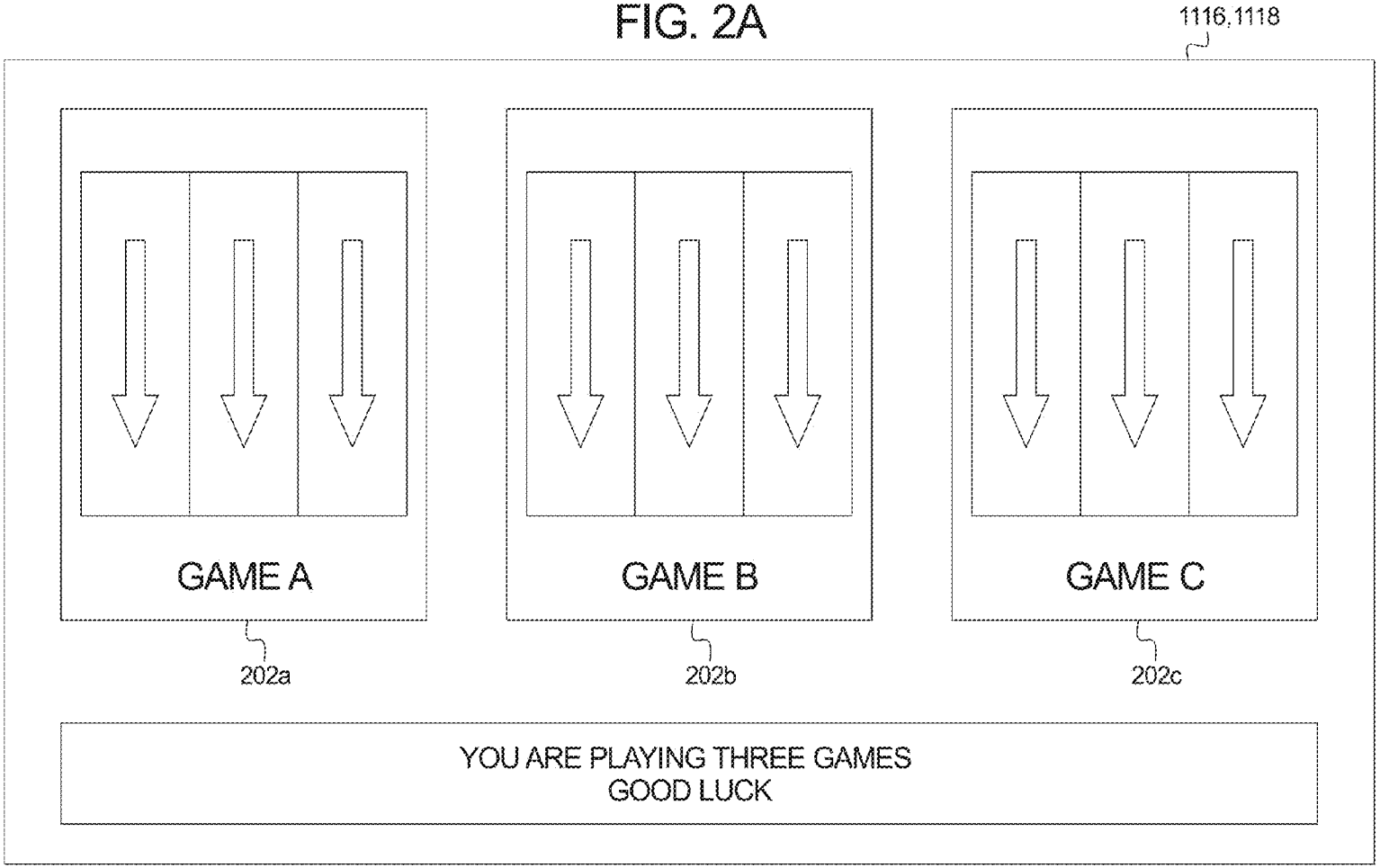
FIGS. 2A, 2B, 2C, 2D, 2E, 2F, 2G and 2H are front views of one embodiment of the gaming system disclosed herein illustrating a play of a plurality of simultaneous or overlappingly game plays and the multi-directional transferring of one or more features.

For example, as seen in FIG. 2A, the gaming system simultaneously triggers, but sequentially displays outcomes for three reel games including a first game 202*a* (illustrated as "GAME A"), a second game 202*b* (illustrated as "GAME B"), and a third game 202*c* (illustrated as "GAME C"). In this example, each of the three games are configured to activate a 2× wild feature or a 5× wild feature. In this example, the gaming system provides appropriate messages such as "YOU ARE PLAYING THREE GAMES" and "GOOD LUCK" to the player visually, or through suitable audio or audiovisual displays.

Figure 2B:
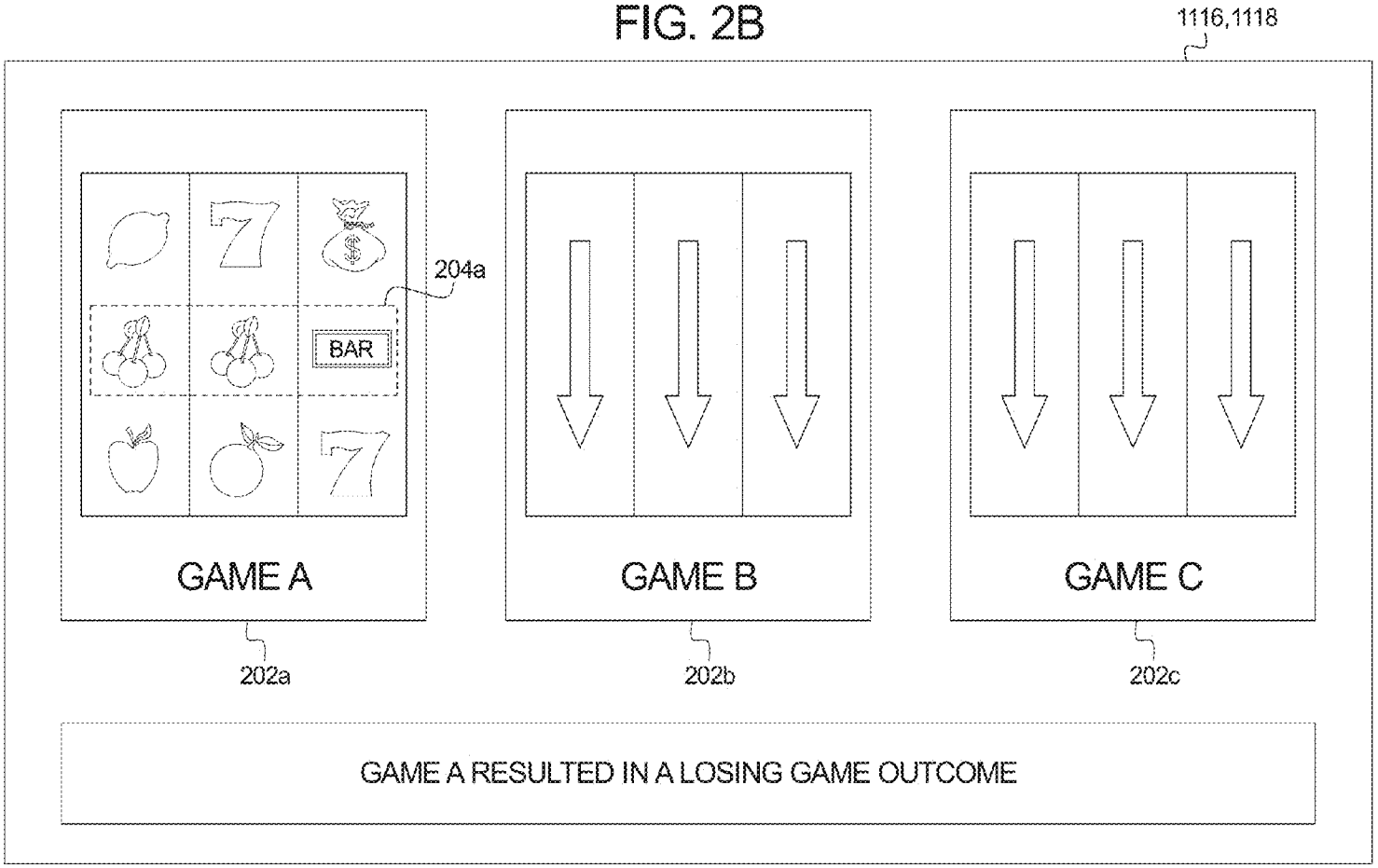

As seen in FIG. 2B, while the gaming system continues to display the reels of the second game 202*b* and the third game 202*c* spinning, the gaming system determines and displays a first outcome 204*a* of a cherry symbol—a cherry symbol—a single bar symbol for the first game 202*a*. This first outcome 204*a* does not include any wild modifier symbols (i.e., no feature activation event occurred in association with this first game play) and thus the gaming system does not activate (and/or transfer) any feature for this play of this game at this point in time. In this example, the gaming system provides appropriate messages such as "GAME A RESULTED IN A LOSING GAME OUTCOME" to the player visually, or through suitable audio or audiovisual displays.

Figure 2C:
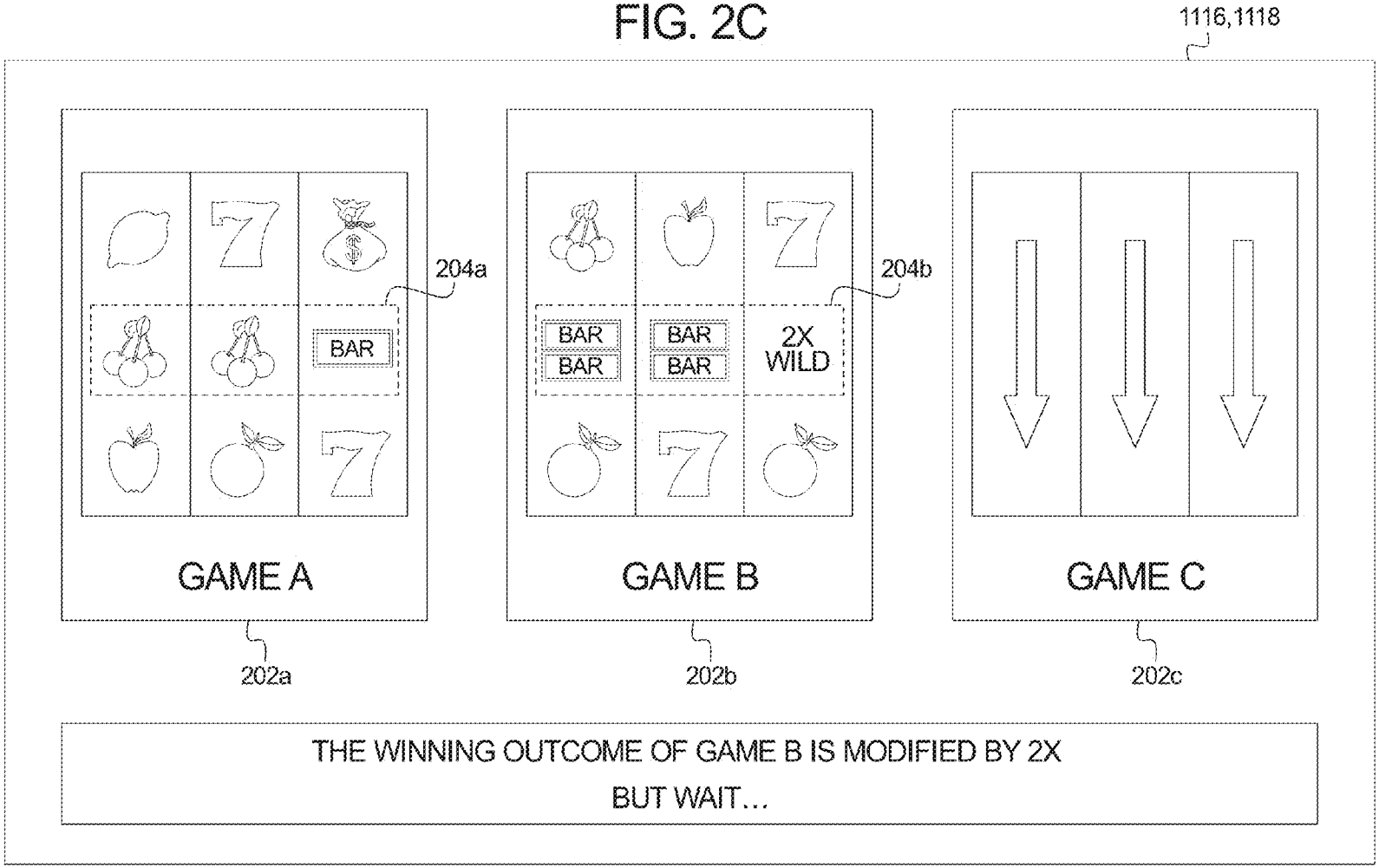

Turning to FIG. 2C, after determining and displaying the first outcome 204*a* for the first game 202*a*, the gaming system determines and displays a second outcome 204*b* of a double bar symbol—a double bar symbol—a 2× wild symbol for the second game 202*b*. This 2× wild modifier symbol qualifies as a 2× wild modifier feature activation event occurring. In this example, the gaming system provides appropriate messages such as "THE WINNING OUTCOME OF GAME B IS MODIFIED BY 2×" and "BUT WAIT . . . " to the player visually, or through suitable audio or audiovisual displays.

Figure 2D:
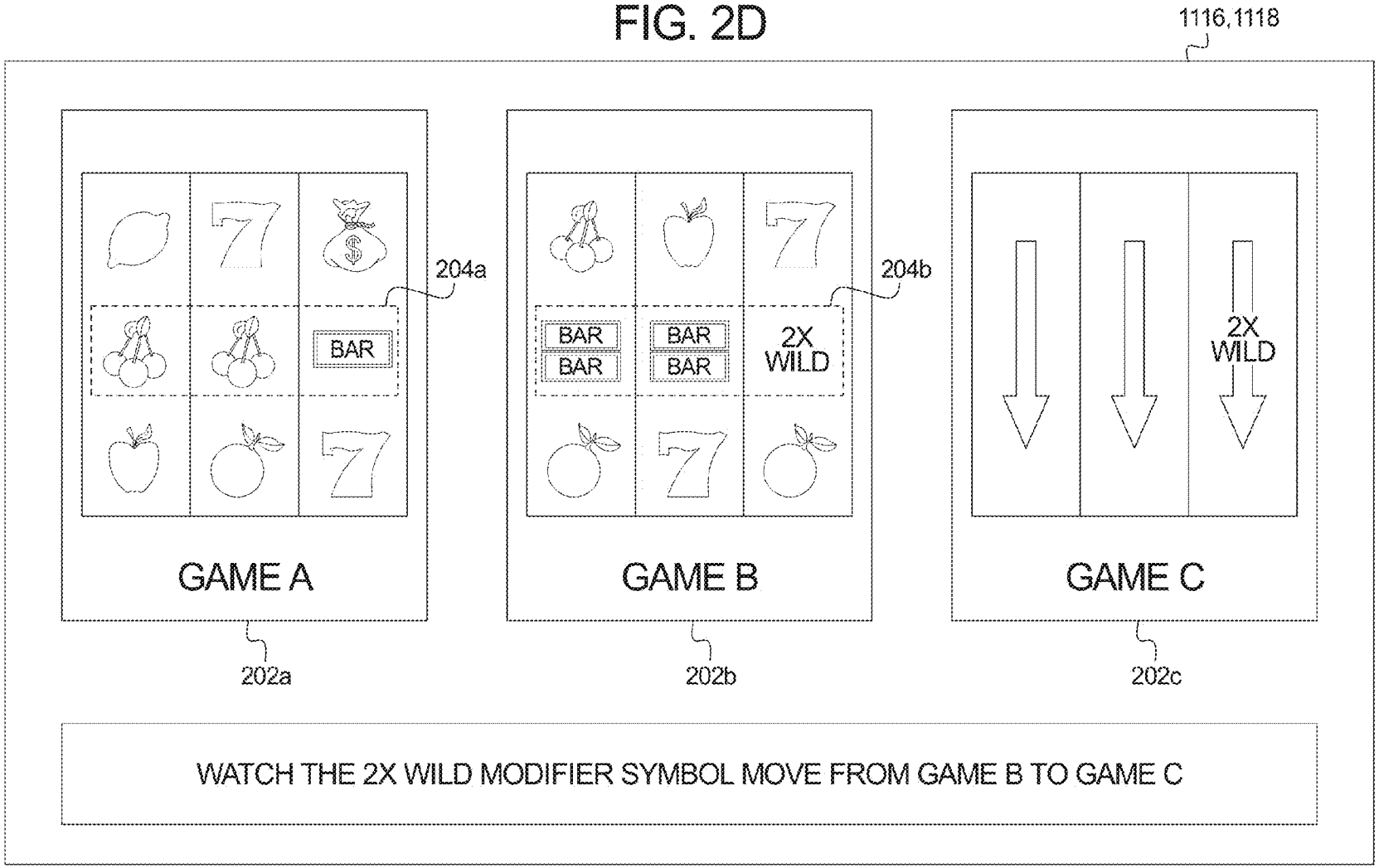

After activating the feature of a 2× wild feature, as seen in FIG. 2D, the gaming system transfers this 2× wild modifier symbol to the third game 202*c*. In this example, the gaming system transfers the 2× wild modifier symbol from a designated symbol display position of the second game 202*b* to a corresponding designated symbol display position of the third game 202*c*. In this example, the gaming system provides appropriate messages such as "WATCH THE 2× WILD MODIFIER SYMBOL MOVE FROM GAME B TO GAME C" to the player visually, or through suitable audio or audiovisual displays.

Figure 2E:
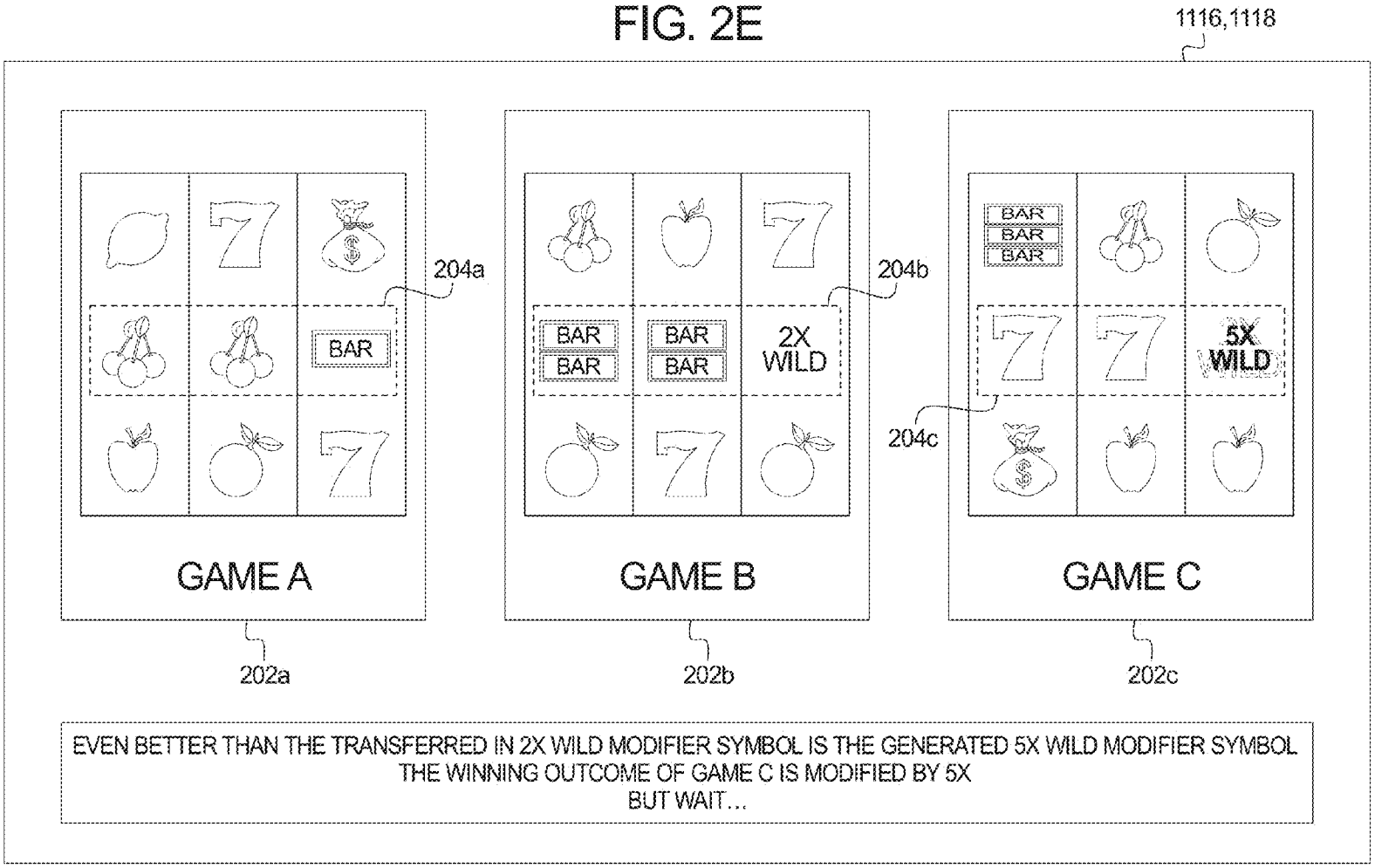

As seen in FIG. 2E, after determining and displaying the second outcome 204*b* for the second game 202*b* and after transferring the activated 2× wild modifier feature to the third game, the gaming system determines and displays a third outcome 204*c* of a seven symbol—a seven symbol—a 5× wild modifier symbol for the third game 202*c*. This 5× wild modifier symbol qualifies as a 5× wild modifier feature activation event occurring. In this example, since the gaming system determines that the 5× wild modifier feature is more lucrative than the 2× wild modifier feature (i.e., the 5× wild modifier feature has a higher average expected payout than the activated 2× wild modifier feature), the gaming system deactivates the 2× wild modifier feature (as seen in phantom) for the third game 202*c* and activates the 5× wild modifier feature for the third game 202*c*. In this example, the gaming system provides appropriate messages such as "EVEN BETTER THAN THE TRANSFERRED IN 2× WILD MODIFIER SYMBOL IS THE GENERATED 5× WILD MODIFIER SYMBOL", "THE WINNING OUTCOME OF GAME C IS MODIFIED BY 5×" and "BUT WAIT . . . " to the player visually, or through suitable audio or audiovisual displays.

Figure 2F:
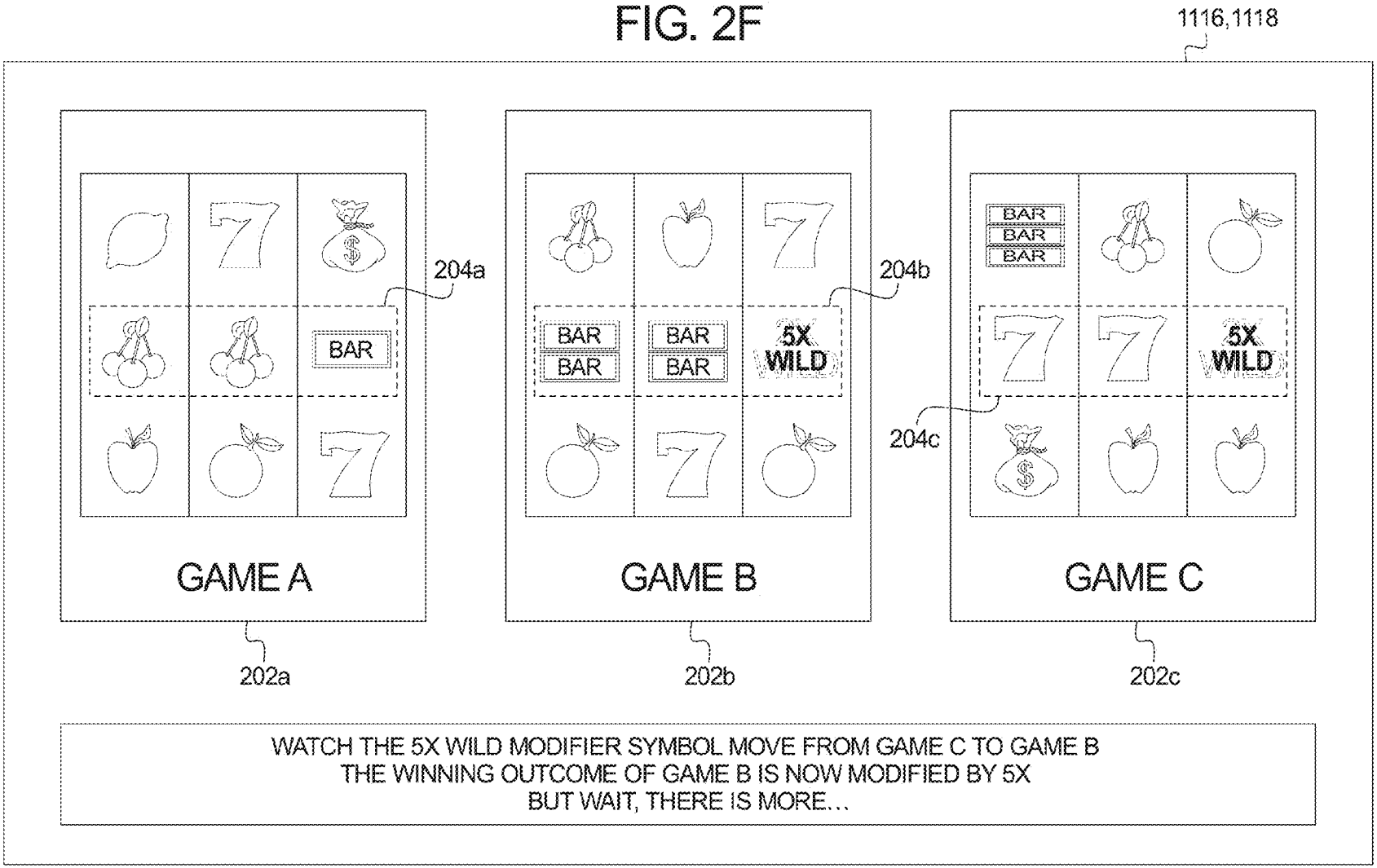

After activating the feature of a 5× wild feature, as seen in FIG. 2F, the gaming system transfers this 5× wild modifier symbol to the second game 202*b*. In this example, the gaming system transfers the 5× wild modifier symbol from a designated symbol display position of the third game 202*c* to a corresponding designated symbol display position of the second game 202*b*. In association with this transfer back, the gaming system determines that since the 5× wild modifier feature is more lucrative than the 2× wild modifier feature (i.e., the 5× wild modifier feature has a higher average expected payout than the activated 2× wild modifier feature), the gaming system deactivates the 2× wild modifier feature (as seen in phantom) for the second game 202*b* and maintains the transferred and activated 5× wild modifier feature for the second game 202*b*. In this example, the gaming system provides appropriate messages such as "WATCH THE 5× WILD MODIFIER SYMBOL MOVE FROM GAME C TO GAME B", "THE WINNING OUTCOME OF GAME B IS NOW MODIFIED BY 5×" and "BUT WAIT, THERE IS MORE . . . " to the player visually, or through suitable audio or audiovisual displays.

Figure 2G:
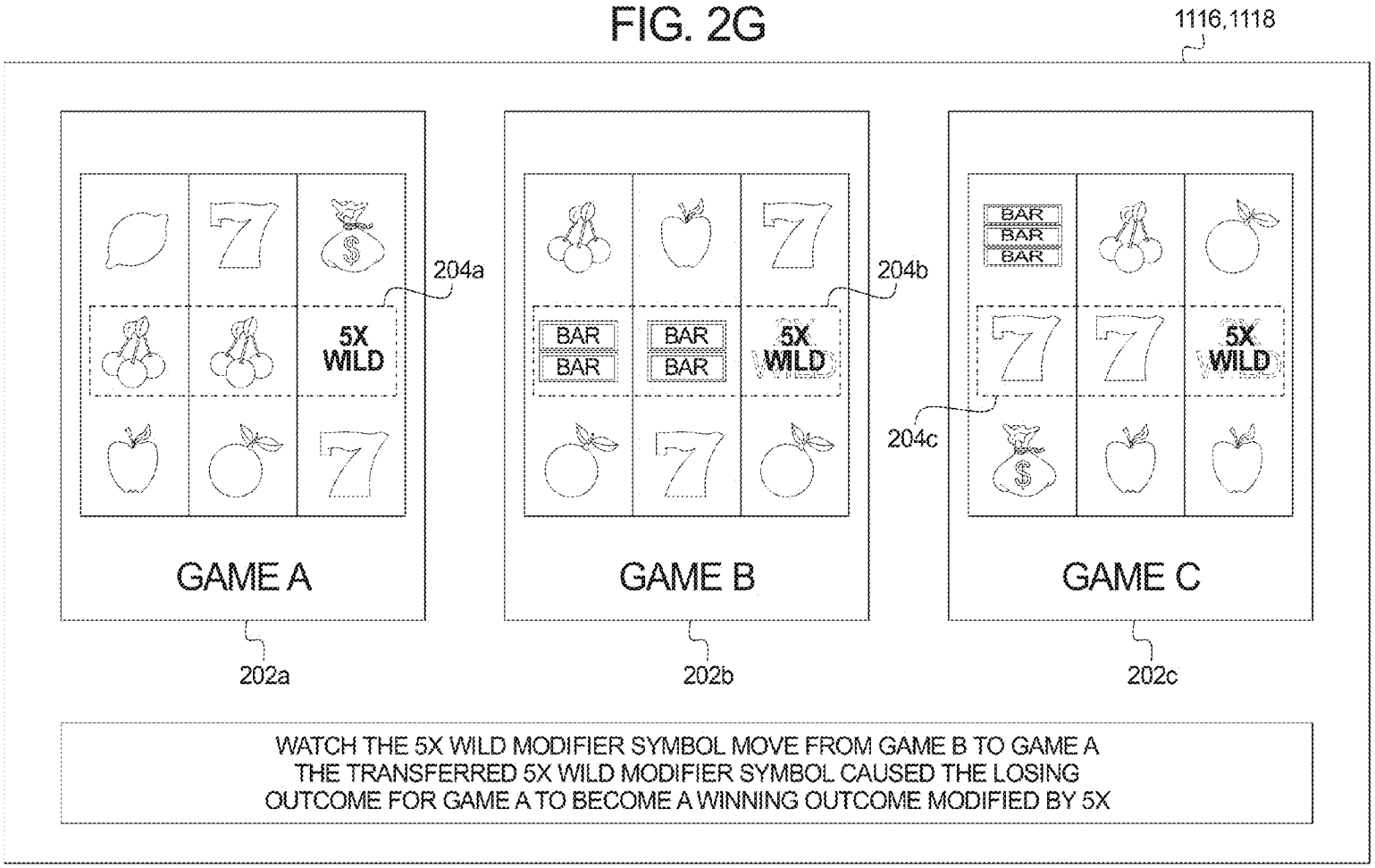

After transferring the feature of a 5× wild feature to the second game 202*b*, as seen in FIG. 2G, the gaming system transfers this 5× wild modifier symbol to the first game 202*a*. In this example, the gaming system transfers the 5× wild modifier symbol from a designated symbol display position of the second game 202*b* to a corresponding designated symbol display position of the first game 202*a*. Such a transfer caused the losing combination of cherry symbol—cherry symbol—single bar symbol to become a winning combination of cherry symbol—cherry symbol—5× wild modifier symbol (i.e., the 5× wild modifier symbol operates as a wild symbol). In this example, the gaming system provides appropriate messages such as "WATCH THE 5×

WILD MODIFIER SYMBOL MOVE FROM GAME B TO GAME A", and "THE TRANSFERRED 5× WILD MODIFIER SYMBOL CAUSED THE LOSING OUTCOME FOR GAME A TO BECOME A WINNING OUTCOME MODIFIED BY 5×" to the player visually, or through suitable audio or audiovisual displays.

Figure 2H:
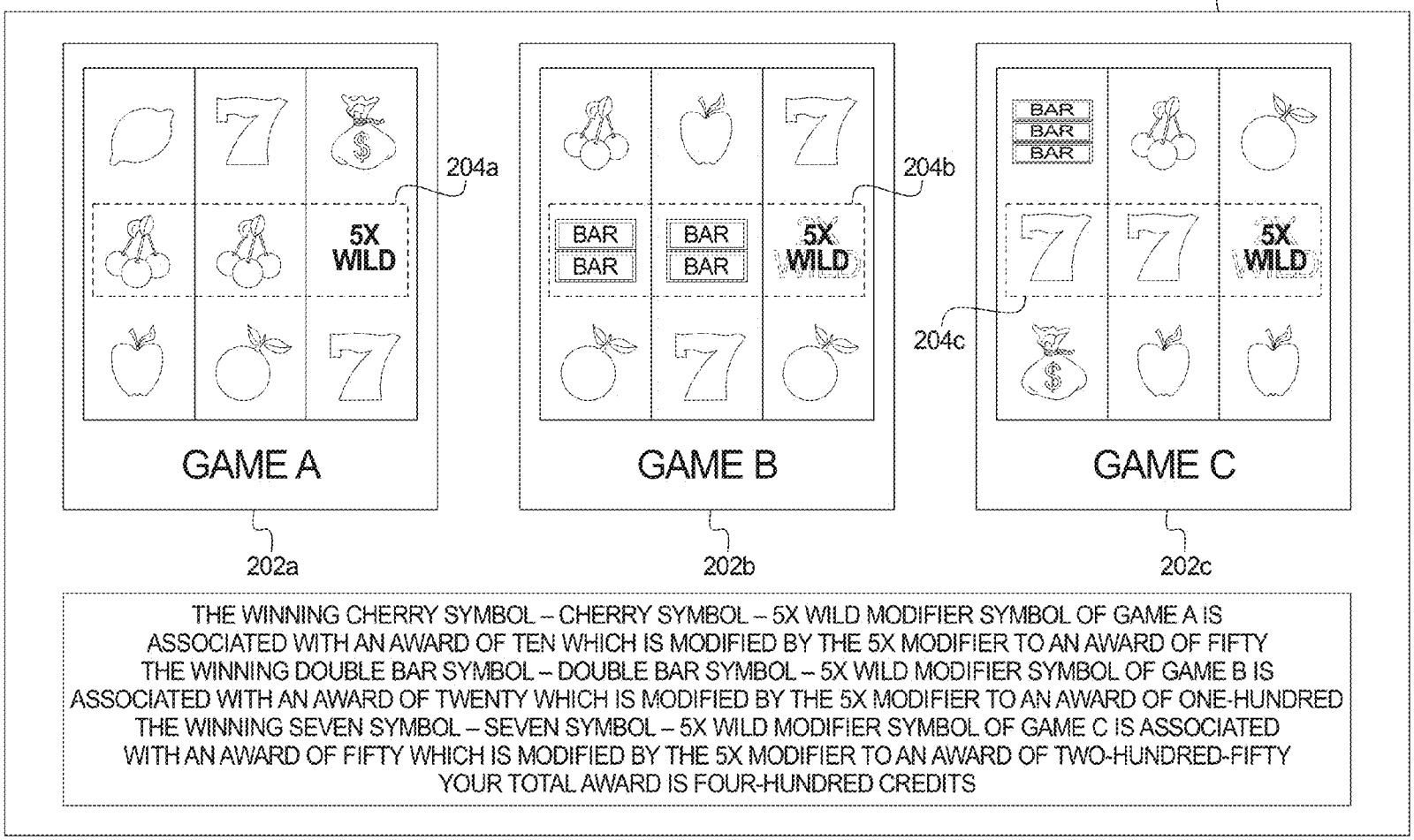

As seen in FIG. 2H, following such a transfer of the 5× wild modifier feature back to the first and second concurrently played games, the gaming system determines that a feature transfer termination event occurred. In this example, such a feature transfer termination event occurred because the gaming system transferred the most lucrative activatable feature (i.e., the 5× wild modifier feature) to each of the three concurrently played games.

As further seen in FIG. 2H, after such a feature transfer termination event, the gaming system determines and displays an award for each of the three concurrently played games. In this example, each of the determined and displayed awards is based, at least in part, on the 5× wild modifier features activated for such game plays. In this example, the gaming system provides appropriate messages such as "THE WINNING CHERRY SYMBOL—CHERRY SYMBOL—5× WILD MODIFIER SYMBOL OF GAME A IS ASSOCIATED WITH AN AWARD OF TEN WHICH IS MODIFIED BY THE 5× MODIFIER TO AN AWARD OF FIFTY", "THE WINNING DOUBLE BAR SYMBOL—DOUBLE BAR SYMBOL—5× WILD MODIFIER SYMBOL OF GAME B IS ASSOCIATED WITH AN AWARD OF TWENTY WHICH IS MODIFIED BY THE 5× MODIFIER TO AN AWARD OF ONE-HUNDRED", "THE WINNING SEVEN SYMBOL—SEVEN SYMBOL—5× WILD MODIFIER SYMBOL OF GAME C IS ASSOCIATED WITH AN AWARD OF FIFTY WHICH IS MODIFIED BY THE 5× MODIFIER TO AN AWARD OF TWO-HUNDRED-FIFTY" and "YOUR TOTAL AWARD IS FOUR-HUNDRED CREDITS" to the player visually, or through suitable audio or audiovisual displays.

In certain embodiments, as seen in FIGS. 2A to 2H, the activated feature transfer occurs between corresponding symbol display positions of multiple games. In certain other embodiments, such a transfer occurs between non-corresponding symbol display positions of multiple games. In one such embodiment, such a transfer occurs between randomly determined symbol display positions. In this embodiment, if the gaming system determines that a designated symbol is generated at a symbol display position of one concurrently played game (i.e., a feature transfer event has occurred), the gaming system randomly selects one or more symbol display positions of one or more concurrently played games to transfer the designated symbol to. In another such embodiment, if the gaming system determines that a designated symbol is generated at a symbol display position of one concurrently played game (i.e., a feature transfer event has occurred), the gaming system randomly selects one or more symbol display positions of one or more randomly selected concurrently played games to transfer the designated symbol to. In certain other embodiments, such a transfer occurs independent of any symbol display positions.

In one embodiment, as illustrated in FIGS. 2A to 2H, one or more activated features from one game are transferred to one or more other concurrently played games before and after an outcome has been determined for such concurrently played games. In another embodiment, one or more activated features from one game are transferred to one or more other concurrently played games before, but not after, an outcome has been determined for such concurrently played games. In another embodiment, one or more activated features from one game are transferred to one or more other concurrently played games after, but not before, an outcome has been determined for such concurrently played games.

In another embodiment, the activation of one or more games is based on one or more features being activated in one or more other game plays. For example, the gaming system activates a first game. If no feature transfer event occurs in association with the first game, no additional games are activated. On the other hand, if a feature transfer event occurs in association with the first game, the gaming system causes both an activation of a second game and the transfer of the activated feature. Such a configuration of activating additional games and transfer one or more activated features to these additionally activated games continues until the gaming system determines that no feature transfer event occurred in association with the currently activated game.

In one embodiment, as described above, two or more of the concurrently played games are linked or otherwise associated with each other wherein the gaming system transfers the activated feature of one concurrently played game to one or more of the other linked or otherwise associated with game plays. For example, as illustrated in FIGS. 2A to 2H, the gaming system sequentially transfers any activated features from one game to another game.

In another embodiment, one or more activated features are linked or otherwise associated with one or more other concurrently played games. In this embodiment, if such a feature is activated, the gaming system indicates (in association with the activated feature) which other concurrently played games that feature should be transferred to. For example, the gaming system includes four concurrently played games arranged in a square-shaped matrix (such that each game has one adjacent horizontal game, one adjacent vertical game and one adjacent diagonal game), In this game, if the gaming system generates a designated symbol, such as a wild modifier symbol, the gaming system displays a directional arrow associated with the generated designated symbol wherein the directional arrow indicates a transfer direction of the generated designated symbol.

As mentioned above, any suitable game, type of game or quantity of games may be implemented as one or more of the simultaneously, concurrently or overlappingly played games disclosed herein. In different embodiments, one or more of the plurality of concurrently played games include, but are not limited to:

i. a play of any suitable slot game;
ii. a play of any suitable free spins or free game activations;
iii. a play of any suitable wheel game;
iv. a play of any suitable card game;
v. a play of any suitable offer and acceptance game;
vi. a play of any suitable award ladder game;
vii. a play of any suitable puzzle-type game;
viii. a play of any suitable persistence game;
ix. a play of any suitable selection game;
x. a play of any suitable cascading symbols game;
xi. a play of any suitable ways to win game;
xii. a play of any suitable scatter pay game;
xiii. a play of any suitable coin-pusher game;
xiv. a play of any suitable elimination game;
xv. a play of any suitable stacked wilds game;
xvi. a play of any suitable trail game;
xvii. a play of any suitable bingo game;
xviii. a play of any suitable video scratch-off game;
xix. a play of any suitable pick-until-complete game;
xx. a play of any suitable shooting simulation game;

xxi. a play of any suitable racing game;
xxii. a play of any suitable promotional game;
xxiii. a play of any suitable high-low game;
xxiv. a play of any suitable lottery game;
xxv. a play of any suitable number selection game;
xxvi. a play of any suitable dice game;
xxvii. a play of any suitable skill game;
xxviii. a play of any suitable auction game;
xxix. a play of any suitable reverse-auction game;
xxx. a play of any suitable group game;
xxxi. a play of any suitable game in a service window;
xxxii. a play of any suitable game on a mobile device; and/or
xxxiii. a play of any suitable game disclosed herein.

In different embodiments, one or more awards provided in association with one or more game plays include one or more of: a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods associated with the gaming system, virtual goods not associated with the gaming system, an access code usable to unlock content on an internet.

In one embodiment, the gaming system causes at least one display device of at least one electronic gaming machine to display the plurality of games. In another embodiment, in addition or in alternative to each electronic gaming machine displaying the plurality of games, the gaming system causes one or more community or overhead display devices to display part or all of the plurality of games to one or more other players or bystanders either at a gaming establishment or viewing over a network, such as the internet. In another embodiment, in addition or in alternative to each electronic gaming machine displaying the plurality of games, the gaming system causes one or more internet sites to each display the plurality of games such that a player is enabled to log on from a personal web browser. In another such embodiment, the gaming system enables the player to play one or more games on one device while viewing the plurality of games from another device, such as a desktop or laptop computer.

In different embodiments, a game initiation event, a feature activation event, a feature transfer event and/or a feature transfer termination event occurs based on an outcome associated with one or more plays of any primary games. In one embodiment, such determinations are symbol driven based on the generation of one or more designated symbols or symbol combinations. In various embodiments, a generation of a designated symbol (or sub-symbol) or a designated set of symbols (or sub-symbols) over one or more plays of a primary game causes such conditions to be satisfied and/or one or more of such events to occur.

In different embodiments, the gaming system does not provide any apparent reasons to the players for an occurrence of a secondary game initiation event (including a designated secondary game initiation event). In these embodiments, such determinations are not triggered by an event in a primary game or based specifically on any of the plays of any primary games. That is, these events occur without any explanation or alternatively with simple explanations.

In one such embodiment, a game initiation event, a feature activation event, a feature transfer event and/or a feature transfer termination event occurs based on an amount of coin-in. In this embodiment, the gaming system determines if an amount of coin-in wagered reaches or exceeds a designated amount of coin-in (i.e., a threshold coin-in amount). Upon the amount of coin-in wagered reaching or exceeding the threshold coin-in amount, the gaming system causes one or more of such events or conditions to occur. In another such embodiment, a game initiation event, a feature transfer event and/or a feature transfer termination event occurs based on an amount of virtual currency-in. In this embodiment, the gaming system determines if an amount of virtual currency-in wagered reaches or exceeds a designated amount of virtual currency-in (i.e., a threshold virtual currency-in amount). Upon the amount of virtual currency-in wagered reaching or exceeding the threshold virtual currency-in amount, the gaming system causes one or more of such events or conditions to occur. In different embodiments, the threshold coin-in amount and/or the threshold virtual currency-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In one such embodiment, a game initiation event, a feature activation event, a feature transfer event and/or a feature transfer termination event occurs based on an amount of coin-out. In this embodiment, the gaming system determines if an amount of coin-out reaches or exceeds a designated amount of coin-out (i.e., a threshold coin-out amount). Upon the amount of coin-out reaching or exceeding the threshold coin-out amount, the gaming system causes one or more of such events or conditions to occur. In another such embodiment, a cascading symbol game initiation event occurs based on an amount of virtual currency-out. In this embodiment, the gaming system determines if an amount of virtual currency-out reaches or exceeds a designated amount of virtual currency-out (i.e., a threshold virtual currency-out amount). Upon the amount of virtual currency-out reaching or exceeding the threshold virtual currency-out amount, the gaming system causes one or more of such events or conditions to occur. In different embodiments, the threshold coin-out amount and/or the threshold virtual currency-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In different embodiments, a game initiation event, a feature activation event, a feature transfer event and/or a feature transfer termination event occurs based on a predefined variable reaching a defined parameter threshold. For example, when the 500,000$^{th}$ player has played an electronic gaming machine (ascertained from a player tracking system), one or more of such events or conditions occur. In different embodiments, the predefined parameter thresholds include a length of time, a length of time after a certain dollar amount is hit, a wager level threshold for a specific device (which electronic gaming machine is the first to contribute $250,000), a number of electronic gaming machines active, or any other parameter that defines a suitable threshold.

In different embodiments, a game initiation event, a feature activation event, a feature transfer event and/or a feature transfer termination event occurs based on a quantity of games played. In this embodiment, a quantity of games played is set for when one or more of such events or conditions will occur. In one embodiment, such a set quantity of games played is based on historic data.

In different embodiments, a game initiation event, a feature activation event, a feature transfer event and/or a feature transfer termination event occurs based on time. In this embodiment, a time is set for when one or more of such events or conditions will occur. In one embodiment, such a set time is based on historic data.

In different embodiments, a game initiation event, a feature activation event, a feature transfer event and/or a feature transfer termination event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the electronic gaming machine. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments, a game initiation event, a feature activation event, a feature transfer event and/or a feature transfer termination event occurs based on a system determination, including one or more random selections by the central controller. In one embodiment, as described above, the gaming system tracks all active electronic gaming machines and the wagers they placed. In one such embodiment, based on the electronic gaming machine's state as well as one or more wager pools associated with the electronic gaming machine, the gaming system determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments, a game initiation event, a feature activation event, a feature transfer event and/or a feature transfer termination event occurs based on a determination of if any numbers allotted to an electronic gaming machine match a randomly selected number. In this embodiment, upon or prior to each play of each electronic gaming machine, an electronic gaming machine selects a random number from a range of numbers and during each primary game, the electronic gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a secondary game initiation event to occur may be implemented in accordance with the gaming system and method disclosed herein.

It should be appreciated that one or more of the above-described triggers pertaining to a game initiation event, a feature transfer event and/or a feature transfer termination event occurring may be combined in one or more different embodiments.

Alternative Embodiments

It should be appreciated that in different embodiments, one or more of:

i. which games or types of games a player is enabled to simultaneously or concurrently play;
ii. a quantity of games a player is enabled to simultaneously or concurrently play;
iii. how the plurality of simultaneously or concurrently played games are displayed to a player;
iv. one or more paytables utilized for a play of one or more of the games;
v. one or more average expected payout percentages of a play of one or more of the games;
vi. one or more awards available for a play of one or more of the games;
vii. one or more ranges of awards available for a play of one or more of the games;
viii. one or more types of awards available for a play of one or more of the games;
ix. one or more generated outcomes (or one or more designated generated outcomes) for a play of one or more of the games;
x. one or more generated outcomes (or one or more designated generated outcomes) associated with an award over a designated value for a play of one or more of the games;
xi. which features, if any, to activate for each game play;
xii. a quantity of features to activate, if any, for each game play,
xiii. if a feature transfer event occurs;
xiv. a quantity of other games an activated feature of one game will be transferred to;
xv. which other games will receive a transferred feature;
xvi. which other games will not receive any transferred features;
xvii. a quantity of transferred in features any game is configured to receive;
xviii. a quantity of features a game is configured to transfer to other games;

xix. when a feature transfer termination event occurs; and/or xx. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines ("EGMs"); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
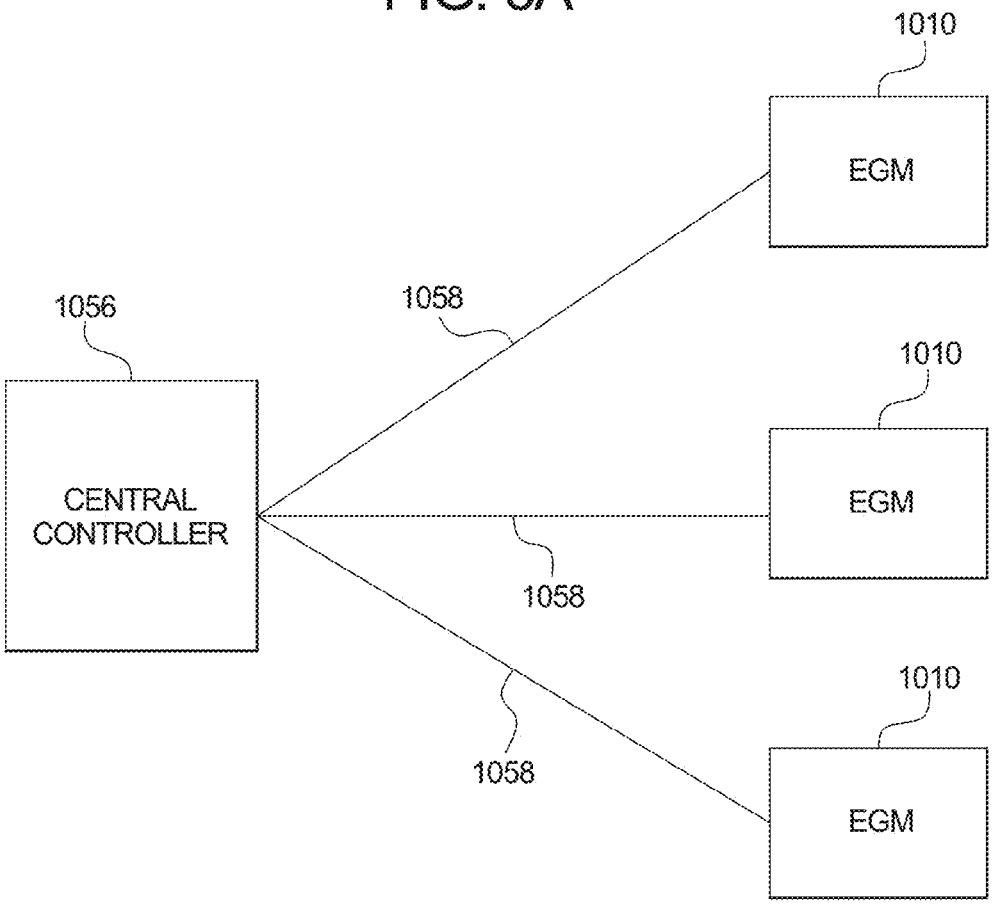
FIG. 3A is a schematic block diagram of one embodiment of a network configuration of the gaming system disclosed herein.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
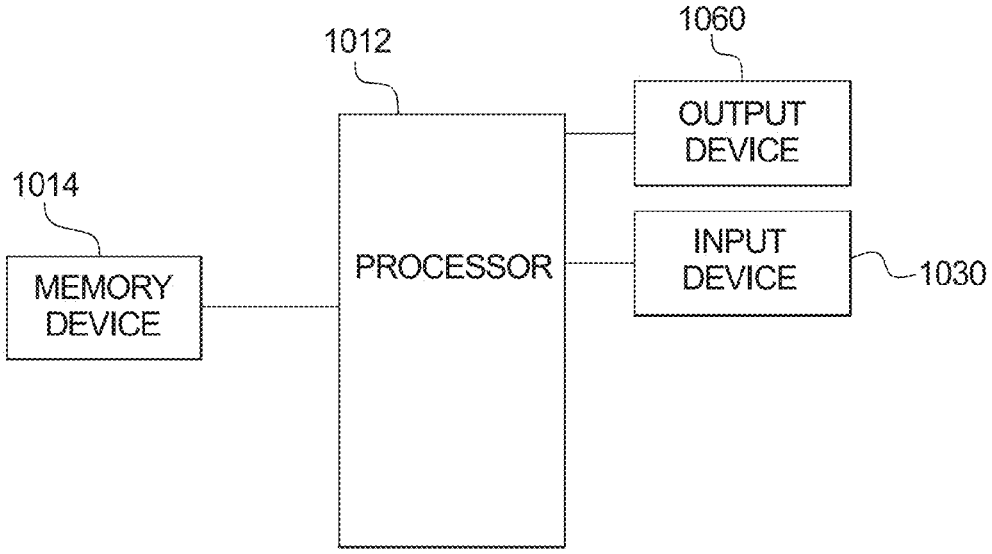
FIG. 3B is a schematic block diagram of one embodiment of an electronic configuration of the gaming system disclosed herein.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
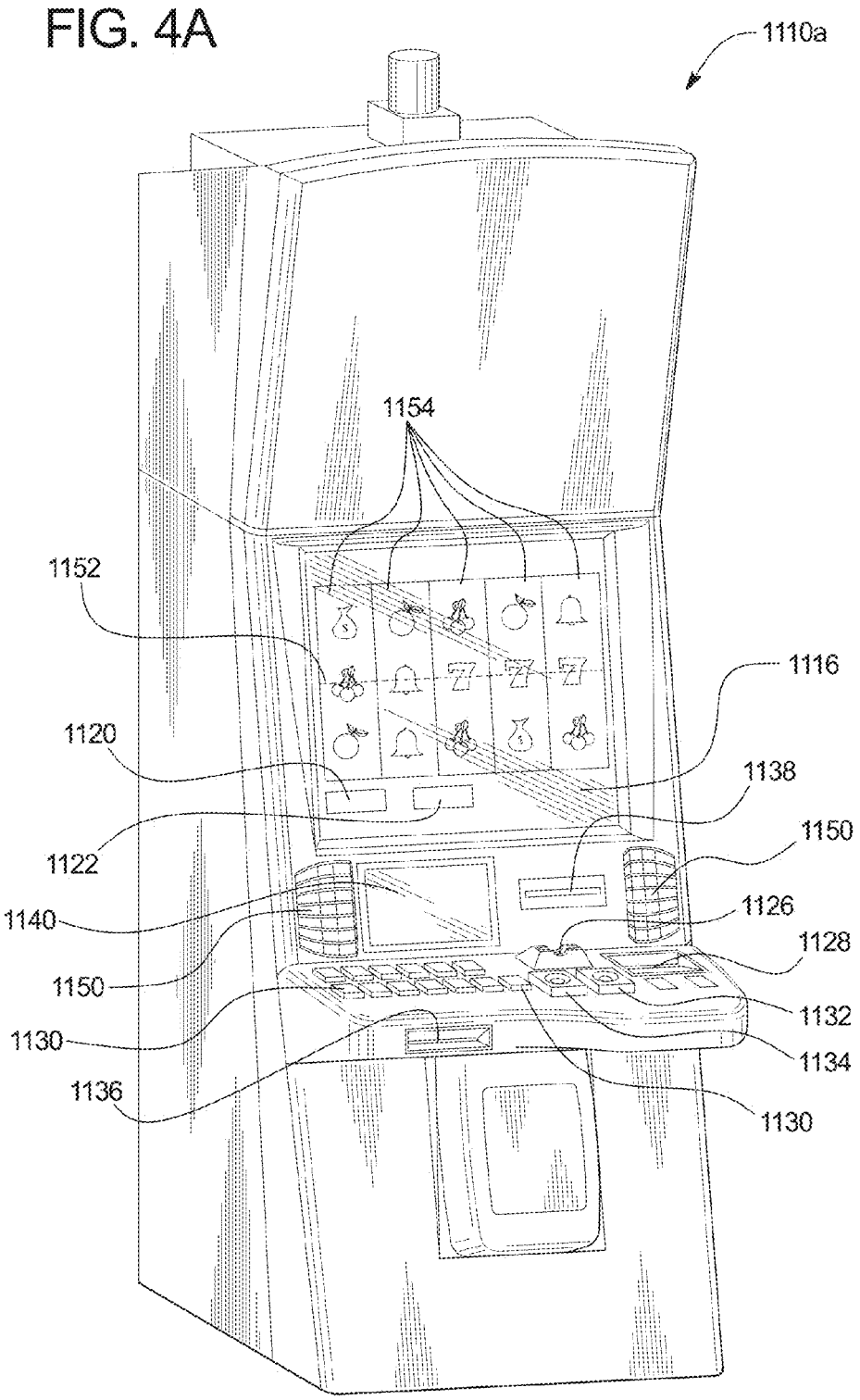
FIGS. 4A and 4B are perspective views of example alternative embodiments of the gaming system disclosed herein.
Figure 4B:
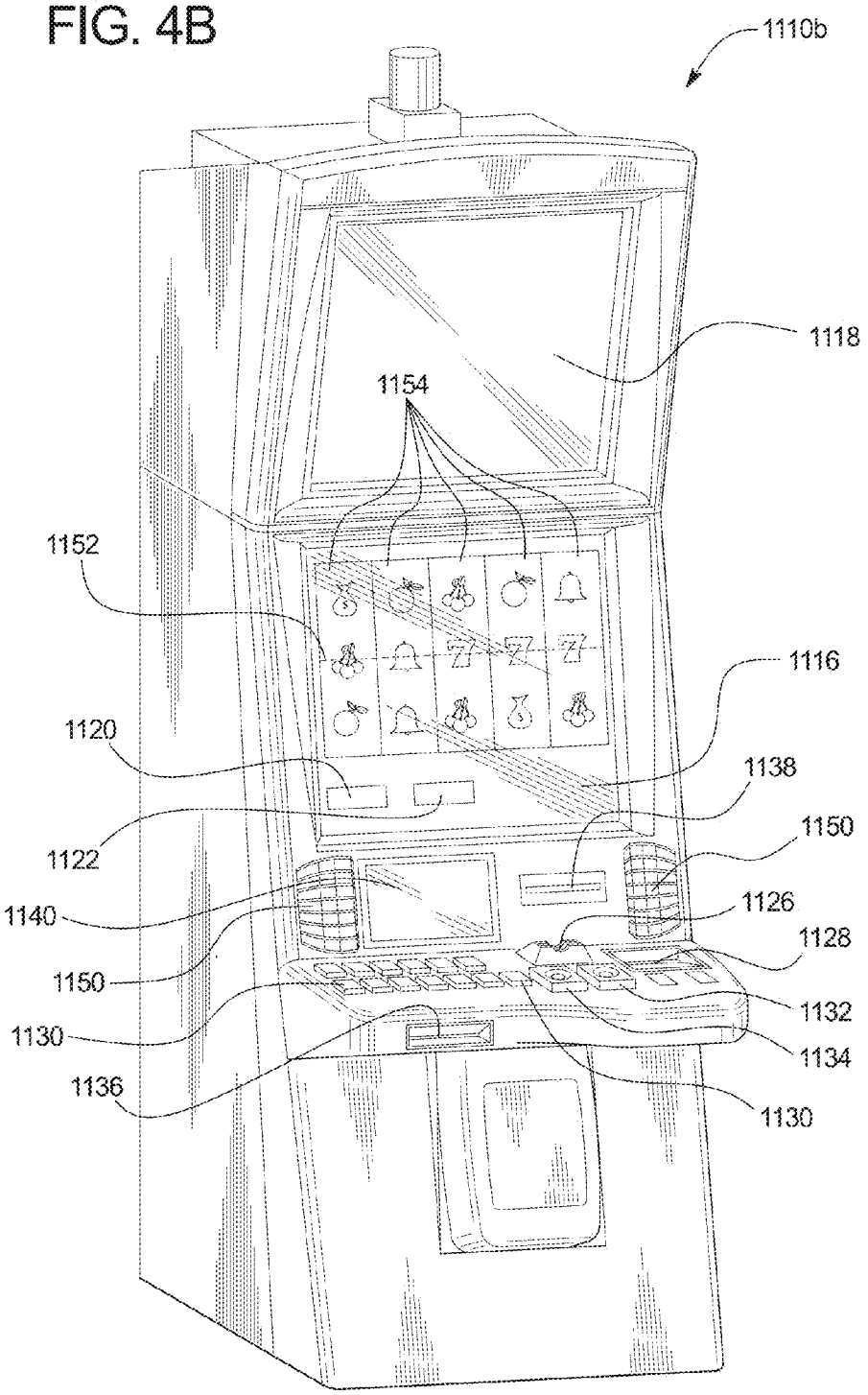

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one. It should be appreciated that while the player's credit balance, the player's wager, and any awards are displayed as an amount of monetary credits or currency in the embodiments described herein, one or more of such player's credit balance, such player's wager, and any awards provided to such player may be for non-monetary credits, promotional credits, and/or player tracking points or credits.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281561 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1156. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game initiation event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor; and at least one memory device which stores a plurality of instructions, which when executed by the at least one processor, cause the at least one processor to:

for a first one of a plurality of overlapping game plays:

determine a first game outcome, communicate data which results in a display device displaying the determined first game outcome, and when a first game feature activation event occurs:

activate a first game feature, and when a first game feature transfer event occurs, replicate said activated first game feature in at least a second one of the overlapping game plays, for the second one of the plurality of overlapping game plays:

determine a second game outcome, communicate data which results in the display device displaying the determined second game outcome, and when a second game feature activation event occurs:
activate a second game feature, and
when a second game feature transfer event occurs, replicate said activated second game feature in at least the first one of the overlapping game plays, and
for each of the plurality of overlapping game plays:
determine an award, said award based on:
the game outcome determined for said overlapping game play, and
at least one of:
any game feature activated for said overlapping game play, and
any activated game feature replicated in said overlapping game play, and
communicate data which results in the display device displaying said determined award.

2. The gaming system of claim 1, wherein when executed by the at least one processor for a third one of the plurality of overlapping game plays, the plurality of instructions cause the at least one processor to:
determine a third game outcome,
communicate data which results in the display device displaying the determined third game outcome, and
when a third game feature activation event occurs:
activate a third game feature, and
when a third game feature transfer event occurs, replicate said activated third game feature in at least one of:
the first one of the overlapping game plays, and
the second one of the overlapping game plays.

3. The gaming system of claim 1, wherein when executed by the at least one processor, the plurality of instructions cause the at least one processor to communicate data which results in the display device displaying a directional indicator associated with at least one of the activated features, said directional indicator indicating which of the overlapping game plays said activated feature will be replicated in.

4. The gaming system of claim 1, wherein when executed by the at least one processor, the plurality of instructions cause the at least one processor to randomly determine at least one of the plurality of overlapping game plays to replicate at least one of the activated game features in.

5. The gaming system of claim 1, wherein the first game feature and the second game feature are different.

6. The gaming system of claim 1, wherein the first game feature activation event and the second game feature activation event are different.

7. The gaming system of claim 1, wherein the first game feature transfer event and the second game feature transfer event are different.

8. The gaming system of claim 1, which includes a housing, and a plurality of input devices supported by the housing, said plurality of input devices including an acceptor, wherein when executed by the at least one processor, the plurality of instructions cause the at least one processor to operate with the plurality of input devices to: responsive to a physical item being received via the acceptor, establish a credit balance based, at least in part, on a monetary value associated with the received physical item, and responsive to a cashout input being received, cause an initiation of any payout associated with the credit balance.

9. The gaming system of claim 1, wherein at least one of the determined awards for at least one of the overlapping game plays is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

10. A method of operating a gaming system, said method comprising:
for a first one of a plurality of overlapping game plays:
determining, by at least one processor, a first game outcome,
causing a display, by at least one display device, of the determined first game outcome, and
when a first game feature activation event occurs:
activating, by the at least one processor, a first game feature, and
when a first game feature transfer event occurs, replicating, by the at least one processor, said activated first game feature in at least a second one of the overlapping game plays,
for the second one of the plurality of overlapping game plays:
determining, by the at least one processor, a second game outcome,
causing a display, by the at least one display device, of the determined second game outcome, and
when a second game feature activation event occurs:
activating, by the at least one processor, a second game feature, and
when a second game feature transfer event occurs, replicating, by the at least one processor, said activated second game feature in at least the first one of the overlapping game plays, and
for each of the plurality of overlapping game plays:
determining, by the at least one processor, an award, said award based on:
the game outcome determined for said overlapping game play, and
at least one of:
any game feature activated for said overlapping game play, and
any activated game feature replicated in said overlapping game play, and
causing a display, by the at least one display device, of said determined award.

11. The method of claim 10, further comprising, for a third one of the plurality of overlapping game plays:
determining, by the at least one processor, a third game outcome,
causing a display, by the at least one display device, of the determined third game outcome, and
when a third game feature activation event occurs:
activating, by the at least one processor, a third game feature, and
when a third game feature transfer event occurs, replicating, by the at least one processor, said activated third game feature in at least one of:
the first one of the overlapping game plays, and
the second one of the overlapping game plays.

12. The method of claim 10, further comprising causing a display, by the at least one display device, of a directional indicator associated with at least one of the activated features, said directional indicator indicating which of the overlapping game plays said activated feature will be replicated in.

13. The method of claim 10, further comprising randomly determining, by the at least one processor, at least one of the plurality of overlapping game plays to replicate at least one of the activated game features in.

14. The method of claim 10, wherein the first game feature and the second game feature are different.

15. The method of claim 10, wherein the first game feature activation event and the second game feature activation event are different.

16. The method of claim 10, wherein the first game feature transfer event and the second game feature transfer event are different.

17. The method of claim 10, wherein the award causes an increase of a credit balance which is increasable via an acceptor of a physical item associated with a monetary value, and decreasable via a cashout device configured to receive an input to cause an initiation of a payout associated with the credit balance.

18. The method of claim 10, wherein at least one of the determined awards for at least one of the overlapping game plays is selected from the group consisting of: a quantity of monetary credits, a quantity of non-monetary credits, a quantity of promotional credits, a quantity of player tracking points, a progressive award, a modifier, a quantity of free plays of the game, a quantity of plays of at least one non-wagering game, at least one lottery based award, a wager match for at least one play of the game, an increase in an average expected payback percentage of the game, at least one comp, a quantity of credits usable for an online play of an online game, a quantity of virtual goods and an access code usable to unlock content on an internet.

19. The method of claim 10, which is provided through a data network.

20. The method of claim 19, wherein the data network is an internet.

21. The gaming system of claim 1, wherein when executed by the at least one processor, the plurality of instructions cause the at least one processor to communicate the data, via a wireless network, to a mobile device.

* * * * *